US005877660A

United States Patent [19]

Ebine et al.

[11] Patent Number: 5,877,660

[45] Date of Patent: Mar. 2, 1999

[54] PHASE SHIFTING DEVICE WITH ROTATABLE CYLINDRICAL CASE HAVING DRIVER MEANS ON THE END WALLS

[75] Inventors: Yoshio Ebine, Yokohama; Masahiro Karikomi, Kawagoe; Tohru Matsuoka, Zama, all of Japan

[73] Assignees: Nihon Dengyo Kosaku Co., Ltd.; NTT Mobile Communications Network Inc., both of Tokyo, Japan

[21] Appl. No.: 898,459

[22] Filed: Jul. 24, 1997

Related U.S. Application Data

[63] Continuation-in-part of Ser. No. 591,674, filed as PCT/JP95/01023 May 29, 1995, abandoned.

[30] Foreign Application Priority Data

Jun. 2, 1994 [JP] Japan ..... 6-143834
Jul. 5, 1994 [JP] Japan ..... 6-175974

[51] Int. Cl.[6] ..... H01P 1/18; H01P 1/165; H01P 1/06

[52] U.S. Cl. ..... 333/159; 333/21 A; 333/161; 333/117; 333/256; 333/261

[58] Field of Search ..... 333/21 A, 117, 333/125, 156, 159, 161, 256, 257, 261

[56] References Cited

U.S. PATENT DOCUMENTS

| | | | |
|---|---|---|---|
| 2,746,018 | 5/1956 | Sichak | 333/256 X |
| 3,668,567 | 6/1972 | Rosen | 333/117 X |
| 3,906,407 | 9/1975 | Levaillant et al. | 333/21 A |
| 4,520,329 | 5/1985 | Cavalieri D'Oro et al. | 333/21 A X |
| 4,757,281 | 7/1988 | Anne et al. | 333/117 |
| 5,010,348 | 4/1991 | Rene et al. | 333/21 A X |
| 5,245,353 | 9/1993 | Gould | 333/125 X |

*Primary Examiner*—Robert Pascal
*Assistant Examiner*—Barbara Summons
*Attorney, Agent, or Firm*—Kanesaka & Takeuchi

[57] ABSTRACT

Input is applied to a two-partition circuit that substantially equally distributes input power into two partitions having a phase difference of 90°, and the thus-distributed output is applied to a first driver that generates circularly polarized wave. The two outputs of the second driver, in which the circularly polarized waves generated from the first driver are coupled, are combined in a combining circuit. The end portion of the opening of the sealed case incorporating the first driver fits together with the end portion of the opening of the sealed case incorporating the second driver such that the two sealed cases together with the first and second drivers may rotate relative to each other around their cylindrical axis. The phase difference between the input of the two-partition circuit and the output of the combining circuit changes according to the relative angle of rotation around the cylindrical axis between first and second drivers.

8 Claims, 21 Drawing Sheets

PHASE SHIFTING DEVICE WITH ROTATABLE CYLINDRICAL CASE HAVING DRIVER MEANS ON THE END WALLS

This application is a continuation-in-part of application Ser. No. 08/591,674, filed Jan. 30, 1996, now abandoned.

TECHNICAL FIELD

The present invention relates to a phase shifting device used in, for example, a transmitting device capable of high output through parallel operation of a plurality of transmitters and a power supply apparatus for directional control of antennas.

BACKGROUND ART

When attempting to vary the direction of maximum radiation or side lobe characteristic of an array antenna by appropriately controlling the driving phase of each of a plurality of radiating elements forming the array antenna, or when attempting to realize a high-output transmitting device by parallel-operating a plurality of transmitters and controlling the output phase of each transmitter such that each is the same phase, line stretchers constructed so as to mechanically vary the length of the transmission line of a signal, or waveguide-type phase shifting devices formed by inserting a dielectric plate within a waveguide have conventionally been used.

FIG. 1 presents several views of a waveguide-type phase shifting device of the prior art, FIG. 1A showing a plan view, FIG. 1B showing a side view, FIG. 1C showing a sectional view taken at the B—B line of Fig. 1B, and Fig. 1D showing a sectional view taken at the A—A line of FIG. 1A.

In rectangular waveguide 11, flanges $\mathbf{12}_1$ and $\mathbf{12}_2$ are provided for inserting and connecting such a waveguide-type phase shifting device within a rectangular waveguide circuit. A dielectric plate 13 is provided within rectangular waveguide 11 such that the plate surface is parallel to the electric field within the waveguide 11. As shown in FIG. 1D, the contour of this dielectric plate 13 is formed as a parallelogram, this parallelogram having inclines on the edges of the radio-wave incident side and edges of the opposite side which are formed so as to improve the radio-wave reflection characteristic at these edge portions.

Instead of providing inclines to the edges of the radio-wave incident side and edges of the opposite side of this dielectric 13, the radio-wave incident portion and opposite side portion of the dielectric 13 may be formed such that the plate thickness gradually varies.

Support fittings $\mathbf{14}_1$ and $\mathbf{14}_2$ for dielectric plate 13 pass through the opposing short sides of rectangular waveguide 11 and dielectric plate 13. Support fittings $\mathbf{14}_1$ and $\mathbf{14}_2$ may freely slide at the portions where they pass through the opposing short sides of rectangular waveguide 11 but are secured to the portions where they pass through dielectric plate 13.

Coupling plate 15 links together support fittings $\mathbf{14}_1$ and $\mathbf{14}_2$. This coupling plate 15 serves as a handle for moving support fittings $\mathbf{14}_1$ and $\mathbf{14}_2$ either forward or backward in the axial direction of each of support fittings $\mathbf{14}_1$ and $\mathbf{14}_2$ while maintaining dielectric plate 13 in the attitude shown in Fig. 1D, thus allowing the plate surfaces of dielectric plate 13 to be moved from a position coinciding with the central axis in the longitudinal direction of rectangular waveguide 11 to a position close to either of the opposing short sides as shown in FIG. 1C, thus enabling variation in the proportion of shift change of radio waves propagated through rectangular waveguide 11.

In other words, such a phase shifting device uses the change in propagation speed of radio waves within rectangular waveguide 11 according to the dielectric constant, thickness, and length in the direction of wave propagation of dielectric plate 13. When interposed at a position coinciding with the central axis in the longitudinal direction of rectangular waveguide 11, where the electric field intensity is at maximum strength, dielectric plate 13 exercises a large effect upon the propagation speed of radio waves, but the electric field strength progressively weakens with distance from the longitudinal central axis of the rectangular waveguide 11 and proximity to either of the short sides, and consequently, as the position of insertion of dielectric plate 13 shifts away from the central axis of rectangular waveguide 11 and approaches either of the short sides, the effect upon the propagation speed of radio waves decreases. Accordingly, the degree of phase shifting can be varied by changing the position of insertion of dielectric plate 13.

Support fittings $\mathbf{14}_1$ and $\mathbf{14}_2$ are maintained parallel to each other, their relative spacing (spacing in relation to the longitudinal direction of rectangular waveguide 11) being selected as $\lambda_g/4$ ($\lambda_g$ is the wavelength within the waveguide corresponding to the employed frequency), whereby reflected waves arising at the support fitting $\mathbf{14}_1$ closer to the radio-wave-incident portion and reflected waves arising at support fitting $\mathbf{14}_2$ which travel back to the position of support fitting $\mathbf{14}_1$ are of mutually reversed phase and cancel each other, thereby enabling an improved reflection characteristic.

A line stretcher used in the prior art must regulate the line length according to the required degree of phase shifting, and therefore, when the required degree of phase shifting is great, not only is a large-scale mechanical structure required, but a relatively time-consuming and labor-intensive adjustment is required to accurately match the line length with the degree of phase shift.

The waveguide-type phase shifting device shown in FIG. 1 involves the drawbacks that a long dielectric plate 13 is required when a large amount of phase shift is called for, resulting in a phase shifting device of large overall size, and that a great deal of time and effort is required to adjust the insertion point of the dielectric plate 13 to accurately match the amount of phase shift with the required value.

FIG. 2 shows a power supply circuit configured using phase shifting devices of the prior art for controlling the driving phase of subarray antennas and for varying the direction of maximum radiation as well as the side lobe characteristic of an array antenna. This power supply circuit is configured from subarray antennas $\mathbf{16}_1$–$\mathbf{16}_4$ each composed of a plurality of element antennas, phase shifting devices $\mathbf{17}_1$–$\mathbf{17}_3$ of the above-described prior art, transmission lines $\mathbf{18}_1$–$\mathbf{18}_3$ having a degree of phase shift that serves as a standard, and two-branch circuits $\mathbf{19}_1$–$\mathbf{19}_3$.

A phase shifting device of the prior art not only entails the same drawbacks as the above-described line stretcher, but when used as shown in FIG. 2, in which a power supply circuit is configured for varying the direction of maximum radiation or side lobe characteristic of an array antenna, further entails the drawback of complex structure of the power supply circuit due to the need for transmission lines $\mathbf{18}_1$–$\mathbf{18}_3$ having an amount of phase shift that serves as a standard and two-branch circuits $\mathbf{19}_1$–$\mathbf{19}_3$ for phase shifting devices $\mathbf{17}_1$–$\mathbf{17}_3$, respectively.

DISCLOSURE OF THE INVENTION

The object of the present invention is to provide a phase shifting device which has a simple and compact structure, and which allows easy adjustment at the time of manufacture and easy handling during use.

To achieve the above-described objects, the present invention proposes a phase shifting device that includes:

two-partition circuit for partitioning input power into two substantially equal portions having a mutual phase difference of substantially 90°;

a first driver for generating circularly polarized waves that is driven by the two-partitioned output of the two-partition circuit;

a second driver for coupling circularly polarized waves generated by the first driver;

two sealed cases within which the first and second drivers are installed so as to be rotatable relative to each other around the axis joining the centers of both drivers; and a combining circuit for combining the two outputs generated from circularly polarized waves coupled in the second driver.

The two-partition output of the two-partition circuit, which distributes the input power in two portions having a mutual phase difference of substantially 90°, is applied to the first driver, which generates from its front surface a circularly polarized wave. This circularly polarized wave couples at the second driver, and the two outputs of the second driver arising from this coupled circularly polarized wave are combined at the combining circuit. When the first and second drivers are rotated relative to each other around the axis that joins the centers of each of the first and second drivers, the phase difference between the input of the two-partition circuit that applies driver power to the first driver and the combined output of the second driver varies in accordance with this rotation.

This phase shifting device allows variation of the degree of phase shift over a range of from 0° to 360°, and moreover, has a simple and compact structure that enables extremely easy adjustment at the time of manufacture and service during use. In addition, the relation between relative angle of rotation of the two sealed cases and the degree of phase shift is proportional, and therefore, the degree of phase shift can be read directly if graduations of degrees are added around the circumference of one of the sealed cases and a pointer is added at a point on the circumference of the other sealed case.

Furthermore, the present invention provides a phase shifting device that includes:

a first driver for generating linearly polarized waves that is driven by input applied by way of an input terminal;

a second driver for coupling two orthogonal components of linearly polarized waves generated by the first driver;

two sealed cases within which the first and second drivers are installed so as to be rotatable relative to each other around the axis joining the centers of both drivers; and a combining circuit for combining the two outputs generated by the two orthogonal components of the linearly polarized wave coupled in the second driver.

When the first driver is driven, linearly polarized waves are generated from the front surface of the driver, and the two orthogonal components of this linearly polarized wave are coupled at the second driver. When the first and second drivers are rotated relative to each other around the axis joining the centers of each of the first and second drivers, the phase difference between the input applied to the first driver and either of the two outputs of the combining circuit to which the two outputs of the second driver are applied varies according to the angle of rotation; and in addition, the phase difference between the two outputs of the combining circuit to which the two outputs of the second driver are applied also varies according to the relative angle of rotation between the first and second drivers.

This phase shifting device allows variation of the degree of phase shift over a range of from 0° to 360°, and moreover, has a simple and compact structure and enables extremely easy adjustment at the time of manufacture and handling during use. In addition, the relation between relative angle of rotation of the two sealed cases and the degree of phase shift is proportional, and therefore, the degree of phase shift can be read directly if graduations of degrees are added around the circumference of one of the sealed cases and a pointer is added at a point on the circumference of the other sealed case.

This phase shifting device is well-suited for control of the direction of maximum radiation or side lobe characteristics of an array antenna because it both allows variation of the phase difference between the input and either one of the two outputs of the combining circuit according to the relative angle of rotation between the sealed cases, and moreover, allows variation of the phase difference between the two outputs according to the relative angle of rotation between the sealed cases.

DETAILED DESCRIPTION OF THE PREFFERED EMBODIMENTS

Figure 3:
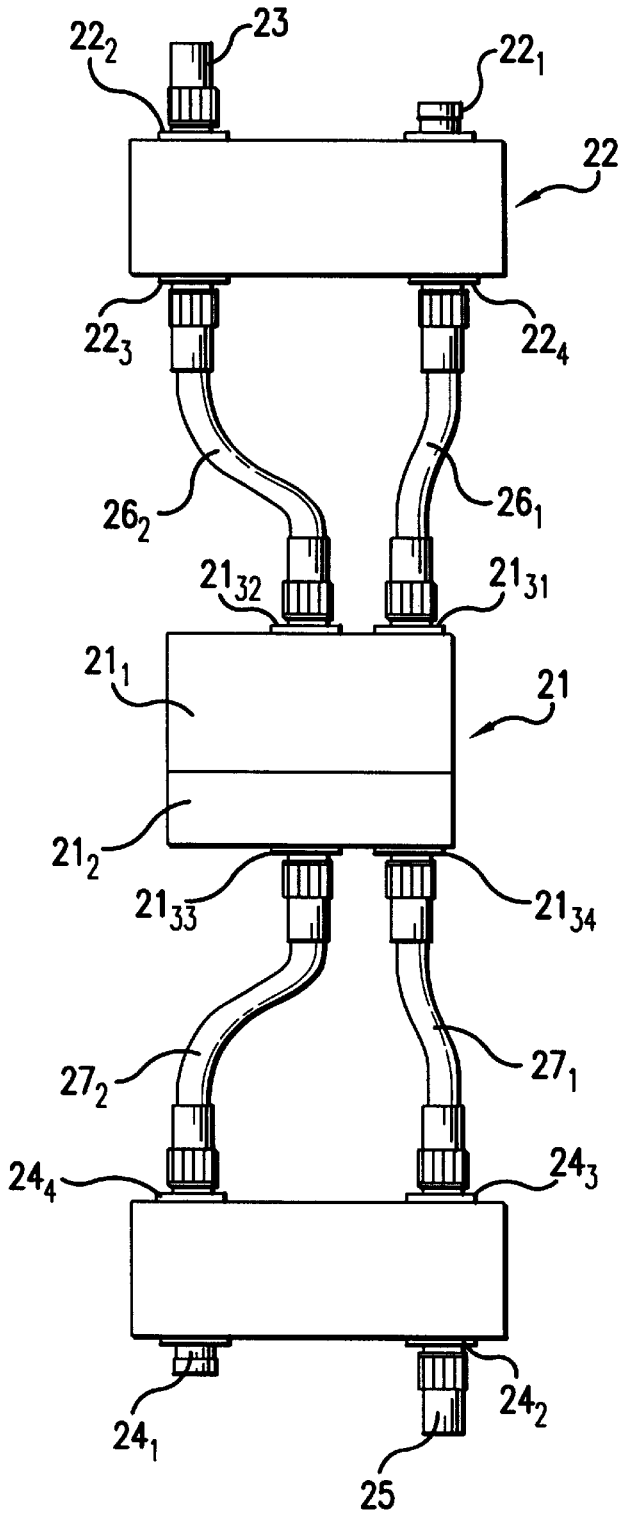
FIG. 3 is a side view of a phase shifting device according to an embodiment of the present invention.

FIG. 3 is a side view of the phase shifting device according to an embodiment of the present invention.

The phase shifting device according to this embodiment is constructed from coupler 21 which includes cylindrical sealed cases $\mathbf{21}_1$ and $\mathbf{21}_2$ which are each closed at one end, and terminals $\mathbf{21}_{31}$–$\mathbf{21}_{34}$ made up of coaxial connection plugs; 90° 3-dB hybrid circuit 22 which is composed of a directional coupler including input terminal $\mathbf{22}_1$, isolation terminal $\mathbf{22}_2$, and output terminals $\mathbf{22}_3$ and $\mathbf{22}_4$; reflectionless terminator 23 connected to isolation terminal $\mathbf{22}_2$; 90° 3-dB hybrid circuit 24 which is composed of a directional coupler including output terminal $\mathbf{24}_1$, isolation terminal $\mathbf{24}_2$, and input terminals $\mathbf{24}_3$ and $\mathbf{24}_4$; reflectionless terminator 25 connected to isolation terminal $\mathbf{24}_2$; coaxial cable $\mathbf{26}_1$ connecting output terminal $\mathbf{22}_4$ and terminal $\mathbf{21}_{31}$; coaxial cable $\mathbf{26}_2$ connecting output terminal $\mathbf{22}_3$ and terminal $\mathbf{21}_{32}$; coaxial cable $\mathbf{27}_1$ connecting terminal $\mathbf{21}_{34}$ and input terminal $\mathbf{24}_3$; and coaxial cable $\mathbf{27}_2$ connecting terminal $\mathbf{21}_{33}$ and input terminal $\mathbf{24}_4$.

Here, the inside diameters of the cylindrical sealed cases $\mathbf{21}_1$ and $\mathbf{21}_2$ are selected so as to give cutoff modes at the designed frequency for smallness of the device. The output power of each of output terminals $\mathbf{22}_3$ and $\mathbf{22}_4$ is ½ of the input power to input terminal $\mathbf{22}_1$, and, for example, the phase of the output of output terminal $\mathbf{22}_3$ is substantially 90° delayed with respect to the phase of the output of output terminal $\mathbf{22}_4$. Furthermore, inputs of equivalent magnitude are applied to each of input terminals $\mathbf{24}_3$ and $\mathbf{24}_4$, the input to input terminal $\mathbf{24}_3$ being, for example, substantially 90° advanced with respect to the phase of input to input terminal $\mathbf{24}_4$.

The lengths of each of coaxial cables $\mathbf{26}_1$ and $\mathbf{26}_2$ are adjusted such that the phase of the output of output terminal $\mathbf{22}_3$ of 90° 3-dB hybrid circuit 22 is delayed substantially 90° with respect to the phase of the output of output terminal $\mathbf{22}_4$, and moreover, such that both outputs are applied to input coaxial connection plugs $\mathbf{21}_{31}$ and $\mathbf{21}_{32}$ of coupler 21 while being kept in a mutually equivalent relation. The lengths of coaxial cables $\mathbf{27}_1$ and $\mathbf{27}_2$ are each adjusted such that the outputs from output coaxial connection plugs $\mathbf{21}_{33}$ and $\mathbf{21}_{34}$ of coupler 21 are applied to the input terminals $\mathbf{24}_3$ and $\mathbf{24}_4$ of 90° 3-dB hybrid circuit 24 with the phase difference and the equal amplitude relation between the outputs maintained unchanged.

Figure 4:
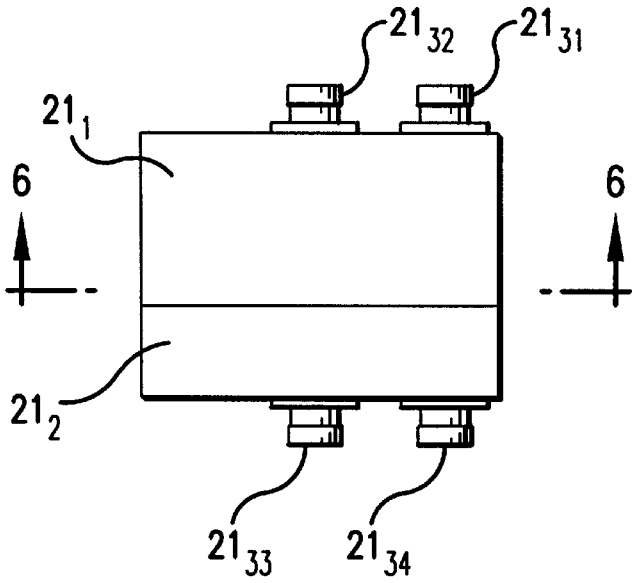
FIG. 4 is a side view of a coupler 21 shown in FIG. 3.
Figure 5:
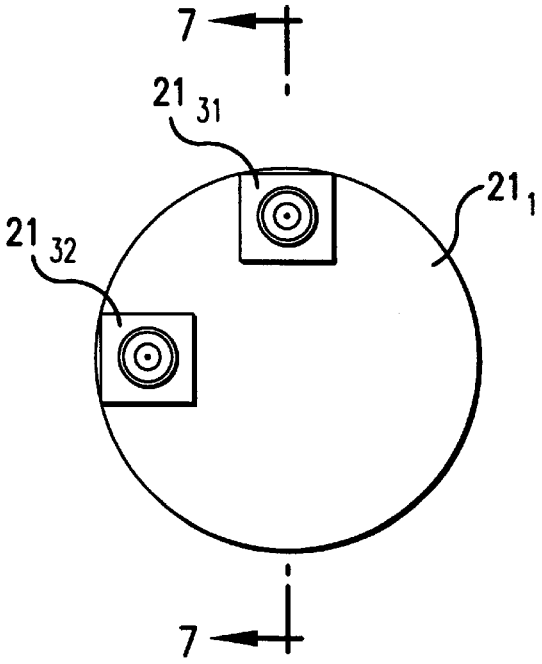
FIG. 5 is a plan view of coupler shown in FIG. 3.
Figure 6:
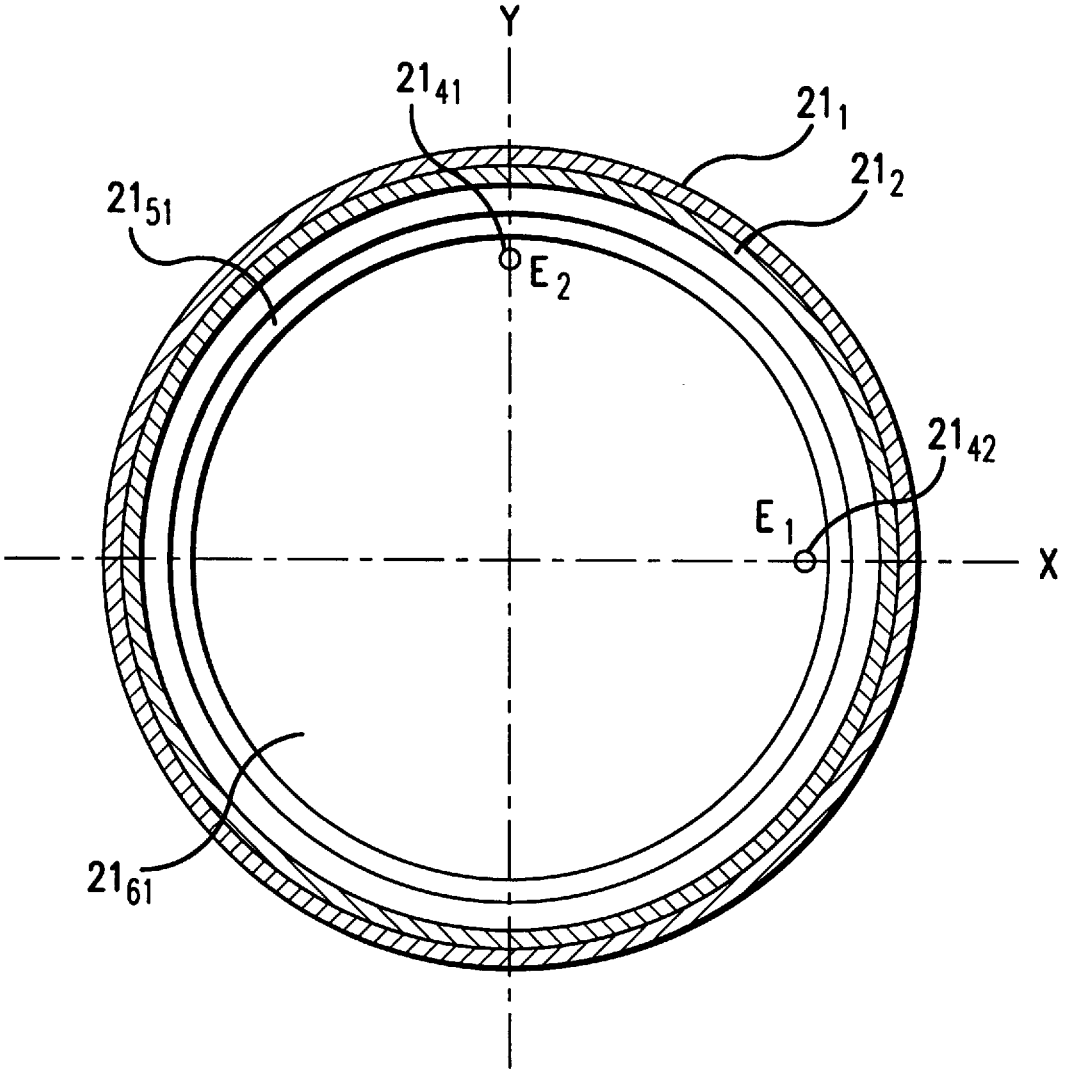
FIG. 6 is a sectional view taken at line C—C of FIG. 4.
Figure 7:
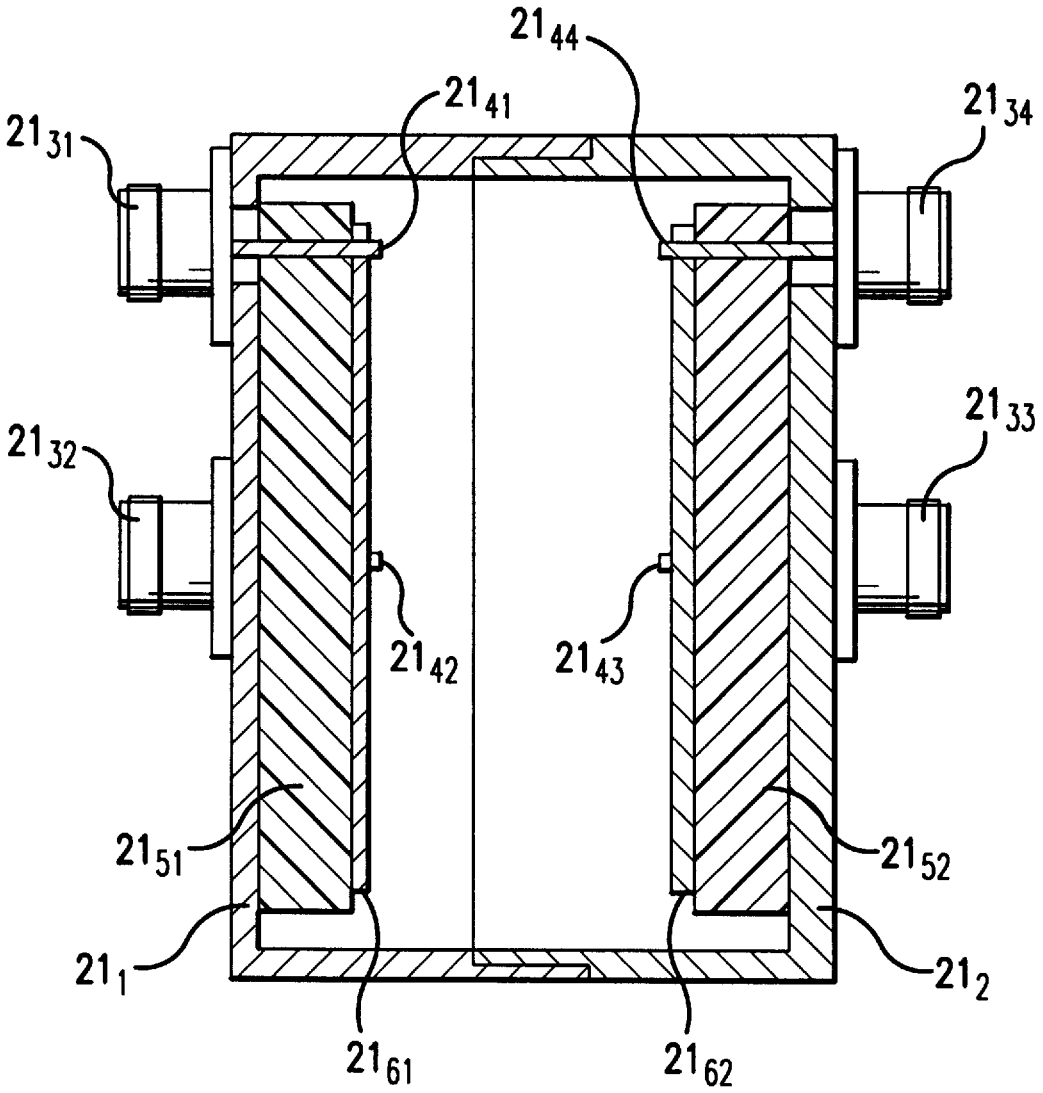
FIG. 7 is a sectional view taken at line D—D of FIG. 5.

FIG. 4 shows a side view of coupler 21 of FIG. 3, FIG. 5 shows a plan view of the sealed case $\mathbf{21}_1$ side of coupler 21 as seen from the bottom side, FIG. 6 is an enlarged sectional view taken along line C—C of FIG. 4, and FIG. 7 is an enlarged sectional view taken along line D—D of FIG. 5.

As can be clearly seen from FIG. 7, stepped portions are formed in the side walls at the end portions of the openings of both of sealed cases $\mathbf{21}_1$ and $\mathbf{21}_2$, the end portion of the opening of sealed case $\mathbf{21}_2$ fitting inside the end portion of the opening of sealed case $\mathbf{21}_1$, the two sealed cases $\mathbf{21}_1$ and $\mathbf{21}_2$ being coupled together as a unit, and sealed cases $\mathbf{21}_1$ and $\mathbf{21}_2$ being constructed so as to allow rotation relative to each other around their cylindrical axis.

Sealed cases $\mathbf{21}_1$ and $\mathbf{21}_2$ are manufactured by first machining a metal block or press-forming a metal sheet in the prescribed shape; by forming a suitable synthetic resin in a preliminary form of the prescribed shape and subsequently applying a metal film to the surface by a electroless plating or vacuum evaporation process; or by multilayer stacking of dielectric plates having an appropriate dielectric constant and forming as a cylinder with one closed end that shields electromagnetic energy in accordance with Snell's law.

Coaxial connection plugs $\mathbf{21}_{31}$ and $\mathbf{21}_{32}$ each include internal conductors $\mathbf{21}_{41}$ and $\mathbf{21}_{42}$. A round insulation plate $\mathbf{21}_{51}$ composed of a material having excellent high-frequency characteristics and a thickness less than the transmission wavelength such as an organic material such as polyethylene or fluorinated ethylene or an inorganic material such as a ceramic is adhered to the inner surface of the bottom wall of sealed case $\mathbf{21}_1$ using a suitable adhesive. Metal plate $\mathbf{21}_{61}$ is secured to the surface of round insulation plate $\mathbf{21}_{51}$ using a suitable adhesive, and in addition, portions of the periphery of metal plate $\mathbf{21}_{61}$ are connected to internal conductors $\mathbf{21}_{41}$ and $\mathbf{21}_{42}$ of coaxial connection plugs $\mathbf{21}_{31}$ and $\mathbf{21}_{32}$, and the first driver composed of a microstrip antenna is formed with sealed case $\mathbf{21}_1$ on the opposite side of round insulation plate $\mathbf{21}_{51}$ as the ground conductor, metal plate $\mathbf{21}_{61}$ as the first driver element, and the contact points between metal plate $\mathbf{21}_{61}$ and interior conductors $\mathbf{21}_{41}$ and $\mathbf{21}_{42}$ of coaxial connection plugs $\mathbf{21}_{31}$ and $\mathbf{21}_{32}$ as the driver points.

As can be seen from FIG. 6, a right angle is formed by the straight line joining the center of metal plate $\mathbf{21}_{61}$ and the driving point constituted by the contact point between metal plate $\mathbf{21}_{61}$ and the interior conductor $\mathbf{21}_{41}$ of coaxial connection plug $\mathbf{21}_{31}$ and the straight line joining the center of metal plate $\mathbf{21}_{61}$ and the driving point constituted by the contact point between metal plate $\mathbf{21}_{61}$ and the internal conductor $\mathbf{21}_{42}$ of coaxial connection plug $\mathbf{21}_{32}$.

In addition, the exterior conductors of each of coaxial connection plugs $\mathbf{21}_{31}$ and $\mathbf{21}_{32}$ are electrically connected to sealed case $\mathbf{21}_1$ and as shown in FIG. 7, a portion of sealed case $\mathbf{21}_1$ has been removed around the periphery of internal conductor $\mathbf{21}_{41}$ to form a gap such that internal conductor $\mathbf{21}_{41}$ makes no mechanical contact with sealed case $\mathbf{21}_1$, and a gap is similarly formed in sealed case $\mathbf{21}_1$ at the portion around the periphery of internal conductor $\mathbf{21}_{42}$.

As the method for securing metal plate $\mathbf{21}_{61}$ to the surface of round insulation plate $\mathbf{21}_{51}$, a setscrew in the center of metal plate $\mathbf{21}_{61}$ (the portion wherein electric field intensity is 0) may also be used to secure the plate to round insulation plate $\mathbf{21}_{51}$ rather than an adhesive, or metal plate $\mathbf{21}_{61}$ may be screwed at its center to the bottom wall of sealed case $\mathbf{21}_1$ through round insulation plate $\mathbf{21}_{51}$, Instead of using metal plate $\mathbf{21}_{61}$, the driver element of the microstrip antenna making up the first driver may be formed by applying a metal film to the surface of round insulation plate $\mathbf{21}_{51}$ by a process such as vacuum evaporation and finishing to the required outline shape by a process such as etching.

Whether the driver element is formed from a metal plate or metal film, its outline shape may instead of a circle be formed as a square, electrical connection with the internal conductors $\mathbf{21}_{41}$ and $\mathbf{21}_{42}$ of coaxial connection plugs $\mathbf{21}_{31}$ and $\mathbf{21}_{32}$ being effected in the corner portions of the square.

Next will be explained the dimensions of driver element $\mathbf{21}_{61}$ for a case in which driver element $\mathbf{21}_{61}$ is driven in basic mode. When the outline shape of driver element $\mathbf{21}_{61}$ is formed as a circle as shown in FIG. 6, if the specific inductive capacity of round insulation plate $\mathbf{21}_{51}$ is $\epsilon_r$ and the design frequency is $f_o$, the radius of driver element $\mathbf{21}_{61}$ is preferably selected as substantially $1.841\ C/(2\pi.\ f_o.\epsilon_r^{1/2})$, and when the outline shape of driver element $\mathbf{21}_{61}$ is formed as a square, the length of one side of driver element $\mathbf{21}_{61}$ is preferably selected as substantially $C/(2f_o.\ \epsilon_r^{1/2})$(C being the speed of light).

Next, in FIG. 7, $\mathbf{21}_{43}$ and $\mathbf{21}_{44}$ are the internal conductors of coaxial connection plugs $\mathbf{21}_{33}$ and $\mathbf{21}_{34}$, respectively, $\mathbf{21}_{52}$ is a round insulation plate, and $\mathbf{21}_{62}$ is the second driver element; the material, method of fabrication, and mutual electrical and mechanical relation of each of these parts being identical to the material, method of fabrication, and mutual electrical and mechanical relation of each of respective coaxial connection plugs $\mathbf{21}_{31}$ and $\mathbf{21}_{32}$, internal conductors $\mathbf{21}_{41}$ and $\mathbf{21}_{42}$, round insulation plate $\mathbf{21}_{51}$, and first driver element $\mathbf{21}_{61}$ on the side of sealed case $\mathbf{21}_1$.

Figure 8:
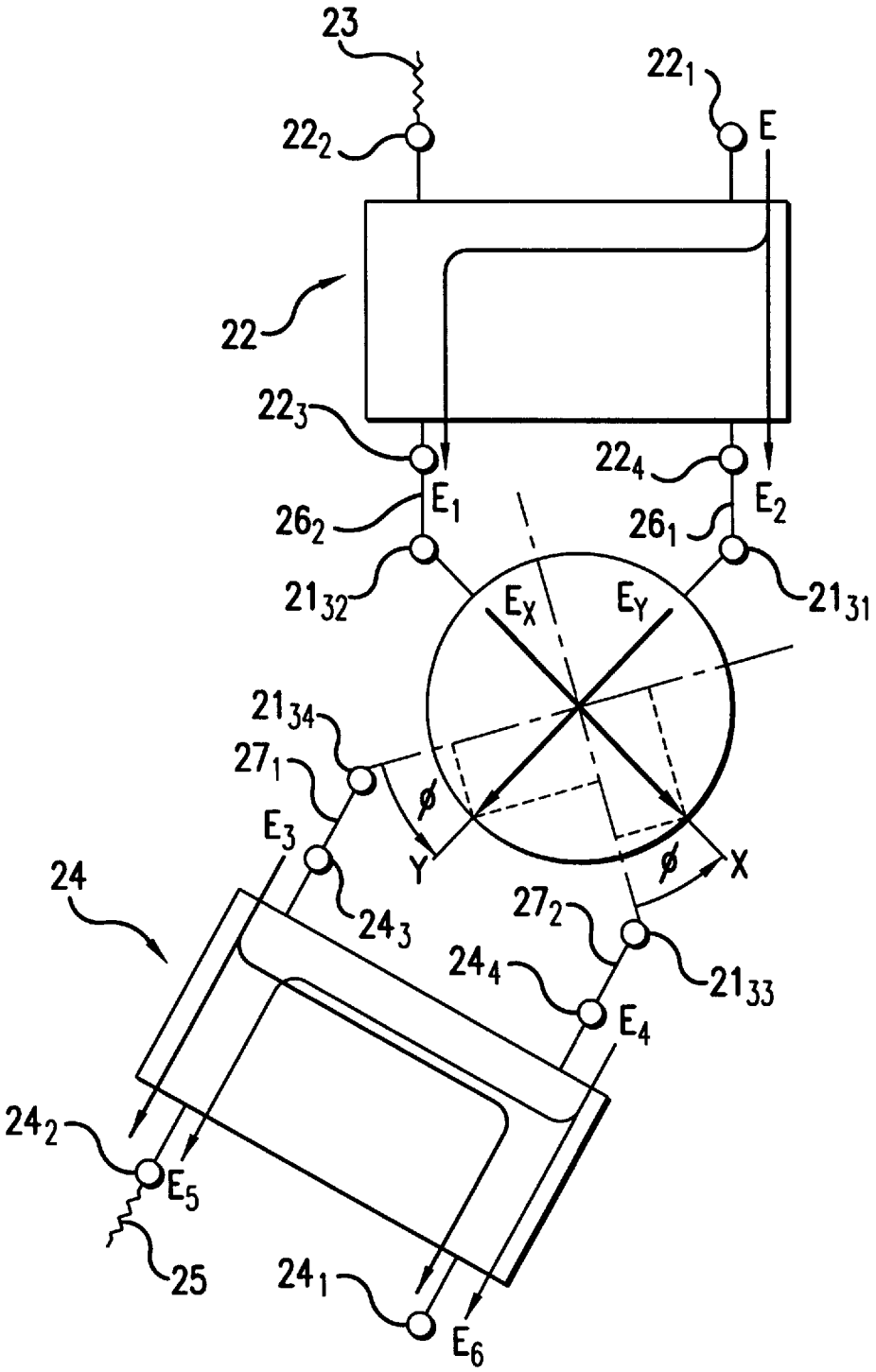
FIG. 8 illustrates the operation of the phase shifting device according to the embodiment of FIG. 3.

FIG. 8 illustrates the operation of this phase shifting device. The input power E applied to the input terminal of 90° 3-dB hybrid circuit 22 is distributed into two substantially equal portions and outputted from output terminals $\mathbf{22}_3$ and $\mathbf{22}_4$, the phase of output $E_1$ of output terminal $\mathbf{22}_3$ being delayed substantially 90° with respect to the phase of output $E_2$ of output terminal $\mathbf{22}_4$.

Output is outputted to isolation terminal $\mathbf{22}_2$ according to the difference between the impedance viewing the load side from output terminal $\mathbf{22}_3$ and the impedance viewing the load side from output terminal $\mathbf{22}_4$, and this output is absorbed by reflectionless terminator 23; however, in a state in which output terminal $\mathbf{22}_3$ and the load are matched and output terminal $\mathbf{22}_4$ and the load are matched, the output outputted to isolation terminal $\mathbf{22}_2$ becomes extremely small, and as a result, the permissible power of reflectionless terminator 23 may be extremely low.

Output $E_1$ of output terminal $\mathbf{22}_3$ of 90° 3-dB hybrid circuit 22 is applied by way of coaxial cable $\mathbf{26}_2$ to the driver point at which internal conductor $\mathbf{21}_{42}$ of coaxial connection plug $\mathbf{21}_{32}$ of coupler 21 connects to first driver element $\mathbf{21}_{61}$. The instantaneous value of the electric field propagated from this driving point in the Z direction (the X-axis and Y-axis are determined as shown in FIG. 6, and the direction perpendicular to the X- and Y-axis is the Z direction) is $E_x$. Output $E_2$ of output terminal $\mathbf{22}_4$ of 90° 3-dB hybrid circuit 22 is applied by way of coaxial cable $\mathbf{26}_1$ to the driver point at which internal conductor $\mathbf{21}_{41}$ of coaxial connection plug $\mathbf{21}_{31}$ of coupler 21 is connected to first driver element $\mathbf{21}_{61}$, and the instantaneous value of the electric field propagated in the Z direction from this driver point is $E_y$. The instantaneous values $E_x$ and $E_y$ of the electric field are:

$$E_1 = -j\frac{E}{\sqrt{2}} \equiv E_X$$

$$E_2 = \frac{E}{\sqrt{2}} = E_Y$$

The electric field propagated in the Z direction couples at the second driver element $\mathbf{21}_{62}$, which together with round insulation plate $\mathbf{21}_{52}$ and the bottom wall of the second sealed case $\mathbf{21}_2$ forms the second driver; but if the angle formed between the straight line joining the center of first driver element $\mathbf{21}_{61}$ with the driver point at which internal conductor $\mathbf{21}_{41}$ of coaxial connection plug $\mathbf{21}_{31}$ of coupler 21 connects to first driver element $\mathbf{21}_{61}$ and the straight line joining the center of second driver element $\mathbf{21}_{62}$ with the driver point at which internal conductor $\mathbf{21}_{44}$ of coaxial connection plug $\mathbf{21}_{34}$ of coupler 21 connects to second driver element $\mathbf{21}_{62}$ is represented by $\phi$, the output of coaxial connection plug $\mathbf{21}_{34}$ is represented by $E_3$, and the output of coaxial connection plug $\mathbf{21}_{33}$ is represented by $E_4$, the outputs $E_3$ and $E_4$ are:

$$E_3 = E_y\cos\phi - E_x\sin\phi$$

$$E_4 = E_y\sin\phi - E_x\cos\phi$$

The output $E_3$ of coaxial connection plug $\mathbf{21}_{34}$ is applied through input terminal $\mathbf{24}_3$ to 90° 3-dB hybrid circuit 24, and output $E_4$ of coaxial connection plug $\mathbf{21}_{33}$ is applied through input terminal $\mathbf{24}_4$ to 90° 3-dB hybrid circuit 24. If the output of isolation terminal $\mathbf{24}_2$ of 90° 3-dB hybrid circuit 24 is represented by $E_5$, and the output of output terminal $\mathbf{24}_1$ is represented by $E_6$, outputs $E_5$ and $E_6$ are respectively:

$$\begin{aligned}
E_5 &= \frac{E_3}{\sqrt{2}} - j\frac{E_4}{\sqrt{2}} \\
&= \frac{1}{\sqrt{2}}\left\{\frac{E}{\sqrt{2}}\cos\phi + j\frac{E}{\sqrt{2}}\sin\phi\right\} - \\
&\quad j\frac{1}{\sqrt{2}}\left\{\frac{E}{\sqrt{2}}\sin\phi - j\frac{E}{\sqrt{2}}\cos\phi\right\} \\
&= 0 \\
E_6 &= \frac{E_3}{\sqrt{2}} + \frac{E_4}{\sqrt{2}} \\
&= -j\frac{1}{\sqrt{2}}\left\{\frac{E}{\sqrt{2}}\cos\phi + j\frac{E}{\sqrt{2}}\sin\phi\right\} + \\
&\quad \frac{1}{\sqrt{2}}\left\{\frac{E}{\sqrt{2}}\sin\phi - j\frac{E}{\sqrt{2}}\cos\phi\right\} \\
&= E\sin\phi - jE\cos\phi \\
&= E\cos\left(\frac{\pi}{2} - \phi\right) - jE\sin\left(\frac{\phi}{2} - \phi\right) \\
&= E\exp\left\{-j\left(\frac{\pi}{2} - \phi\right)\right\}
\end{aligned}$$

In other words, in this phase shifting device, the phase of the output of output terminal $\mathbf{24}_1$ of 90° 3-dB hybrid circuit 24 can be shifted by $\phi$ with respect to the phase of the input to input terminal $22_1$ of 90° 3-dB hybrid circuit 22 by simply rotating the sealed cases $21_1$ and $21_2$ with respect to each other by the angle $\phi$.

Figure 9:
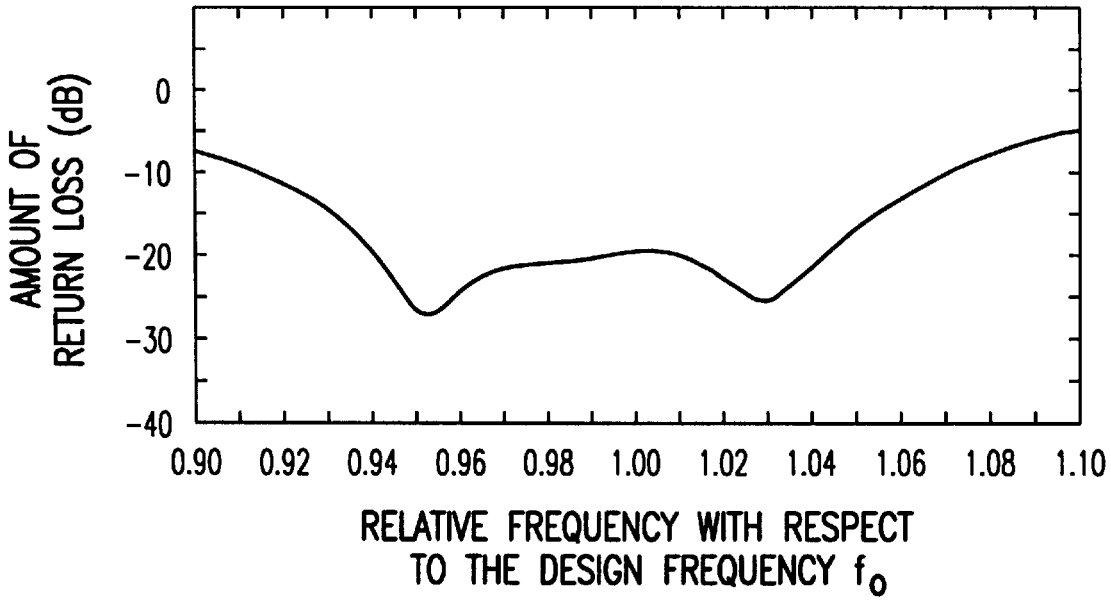
FIG. 9 shows the return loss characteristic in coaxial connection plug $\mathbf{21}_{31}$ of the phase shifting device of the embodiment shown in FIG. 3.

FIG. 9 shows the reflection characteristics at coaxial connection plug $21_{31}$ (see FIG. 7 regarding the following dimensions) for a case in which the inside diameter of the cylinders having one closed end that form sealed cases $2l_1$ and $21_2$ of coupler 21 are selected as 0.285 $\lambda_o$ which is one of the size that give cutoff mode at the designed frequency, ($\lambda_o$ being the free space wavelength corresponding to the designed frequency $f_o$), the distance between the bottom wall of sealed case $21_1$ and the bottom wall of sealed case $21_2$ is set at 0.089 $\lambda_o$, the specific inductive capacity of each of round insulation plates $21_{51}$ and $21_{52}$ is set at 10, the dielectric dissipation factor of each of round insulation plates $21_{51}$ and $21_{52}$ is set at 0.0055, the thickness of round insulation plates $21_{51}$ and $21_{52}$ is set at 0.023 $\lambda_o$, and each of the first and second driver elements $21_{61}$ and $21_{62}$ are formed in a circular shape of diameter 0.21 $\lambda_o$. Here, the axis of abscissas shows the relative frequency with respect to the design frequency $f_o$, and the axis of ordinates shows the amount of return loss (dB).

Figure 10:
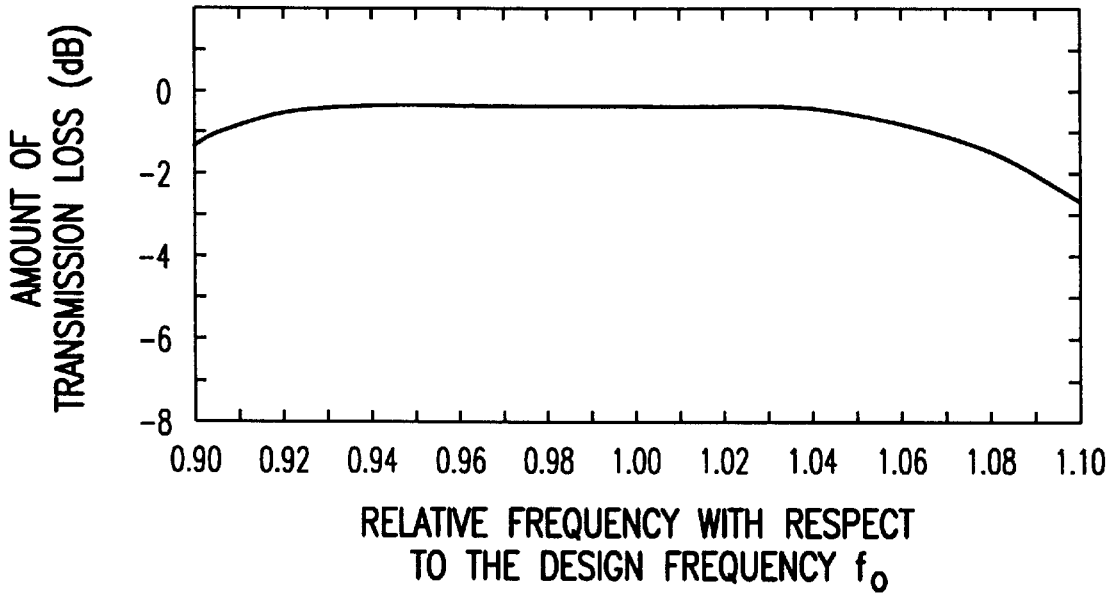
FIG. 10 shows the transmission loss characteristic between coaxial connection plugs $\mathbf{21}_{31}$ and $\mathbf{21}_{34}$ of the phase shifting device of the embodiment shown in FIG. 3.

FIG. 10 shows the transmission characteristics between coaxial connection plugs $21_{31}$ and $21_{34}$ for a case in which each of the dimensions of coupler 21 is the same as for FIG. 9, the axis of abscissas being equivalent to FIG. 9 and the axis of ordinates showing the amount of transmission loss (dB).

As can be seen from FIG. 9 and FIG. 10, coupler 21 exhibits excellent reflection characteristics and transmission characteristics over a broad band.

Furthermore, the thickness of round insulation plates $21_{51}$ and $21_{52}$ of coupler 21 can be selected according to the transmission frequency band, and the bandwidth can be broadened by increasing the thickness from the selected thickness.

Figure 11:
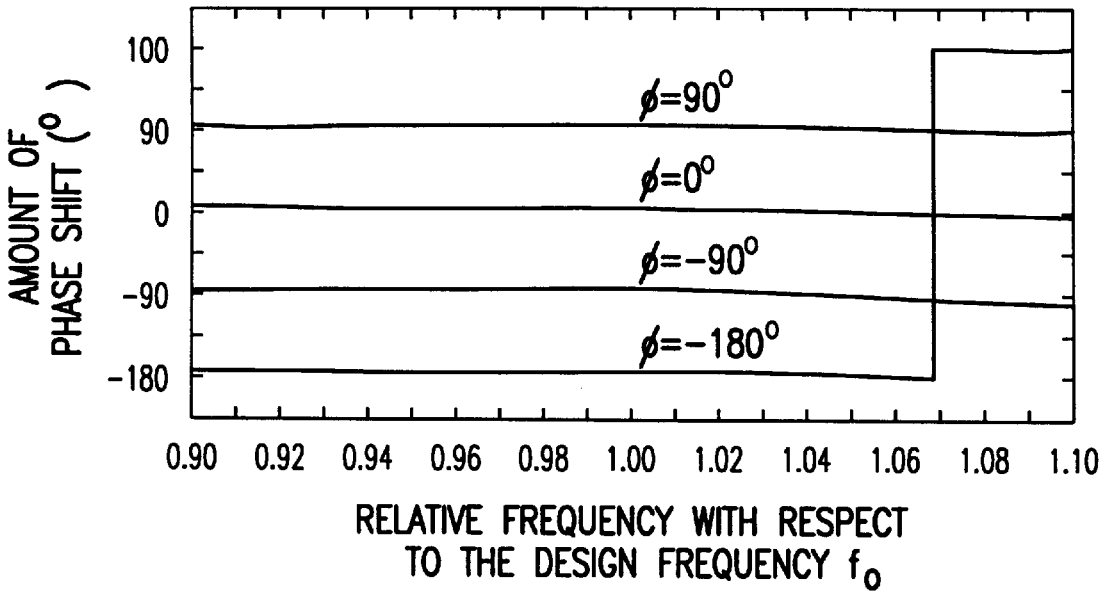
FIG. 11 shows the degree of phase shift in relation to the relative angle of rotation $\phi$ between sealed cases $\mathbf{21}_1$ and $\mathbf{21}_2$ in the phase shifting device of the embodiment shown in FIG. 3.

FIG. 11 shows observation results of changes in phase of the output from output terminal $24_1$ of 90° 3-dB hybrid circuit 24 with respect to the phase of the input to input terminal $22_1$ of 90° 3-dB hybrid circuit 22, the axis of abscissas showing the frequencies relative to the design frequency $f_o$ and the axis of ordinates showing the amount of phase shift (°) with respect to the angle of rotation $\phi$, each of the dimensions of coupler 21 being selected in the same way as explained for FIG. 9, the phase shifting device being configured with 90° 3-dB hybrid circuit 22 connected to coupler 21 by way of coaxial cables $26_1$ and $26_2$ and 90° 3-dB hybrid circuit 24 connected to coupler 21 by way of coaxial cables $27_1$ and $27_2$ as shown in FIG. 3, and $\phi$ representing the angle of rotation by which the sealed cases $21_1$ and $21_2$ forming coupler 21 have been rotated relative to each other around their common cylindrical axis.

As is clear from FIG. 11, regardless of the transmission frequency, the amount of phase shift always coincides with the angle of rotation $\phi$ of sealed cases $21_1$ and $21_2$ making up coupler 21 with respect to each other around their common cylindrical axis.

Figure 12:
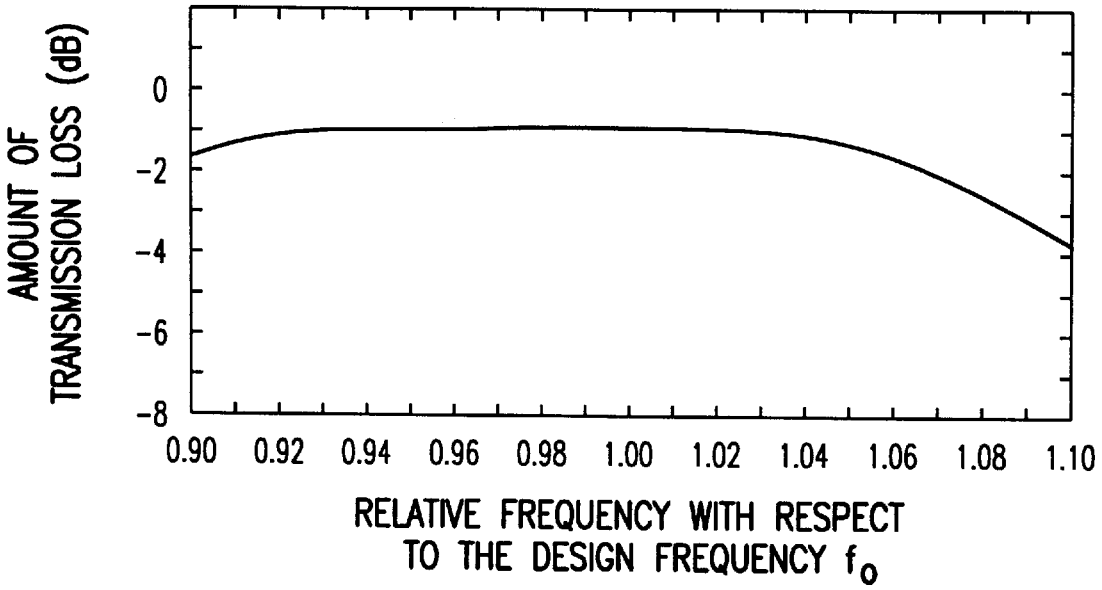
FIG. 12 shows the transmission loss characteristic between input terminal $\mathbf{22}_1$ and output terminal $\mathbf{24}_1$ in the phase shifting device of the embodiment shown in FIG. 3.

FIG. 12 shows the observation results of the amount of transmission loss between input terminal $22_1$ of 90° 3-dB hybrid circuit 22 and output terminal $24_1$ of 90° 3-dB hybrid circuit 24 under the same conditions as for the observations in which the results of FIG. 11 were obtained, the axis of abscissas being the same as for FIG. 11 and the axis of ordinates showing the amount of transmission loss (dB).

As is clear from FIG. 12, compared to the amount of transmission loss shown in FIG. 10 for coupler 21 alone, the addition of 90° 3-dB hybrid circuits 22 and 24, coaxial cables $26_1$ and $26_2$, as well as $27_1$ and $27_2$ increases the transmission loss, but the degree of change in the frequency characteristic of the amount of transmission loss is as for coupler 21 alone.

The foregoing explanation relates to a case (see FIG. 7) in which sealed cases $21_1$ and $21_2$ of coupler 21 are formed from metal; the first driver installed within coupler 21 is formed from a microstrip antenna composed of sealed case $21_1$, which is the ground conductor, round insulation plate $21_{51}$, and driver element $21_{61}$; and the second driver is formed from a microstrip antenna composed of sealed case $21_2$, which is the ground conductor, round insulation plate $21_{52}$, and driver element $21_{62}$. However, in a case in which sealed cases $21_1$ and $21_2$ are formed by applying a metal film to the outer surface of a body composed of a suitable synthetic resin, the metal film applied to the outer surface of the body of sealed case $21_1$ can serve as the ground conductor, the body of sealed case $21_1$ can serve as round insulation plate $21_{51}$, and the first driver composed of a microstrip antenna can therefore be formed by attaching driver element $21_{61}$ to the inner surface of the bottom wall of sealed case $21_1$, and the second driver composed of a microstrip antenna can similarly be formed by attaching driver element $21_{62}$ to the inner surface of the bottom wall of sealed case $21_2$.

In a case in which sealed cases $21_1$ and $21_2$ are formed by multilayer stacking of dielectric plates, the first driver composed of a microstrip antenna can be formed by attaching driver element $21_{61}$ to the inner surface of the bottom wall of sealed case $21_1$ and attaching a ground conductor to the outer surface of the bottom wall; and the second driver composed of a microstrip antenna can be formed by attaching driver element $21_{62}$ to the inner surface of the bottom wall of sealed case $21_2$ and attaching a ground conductor to the outer surface of the bottom wall.

Figure 13:
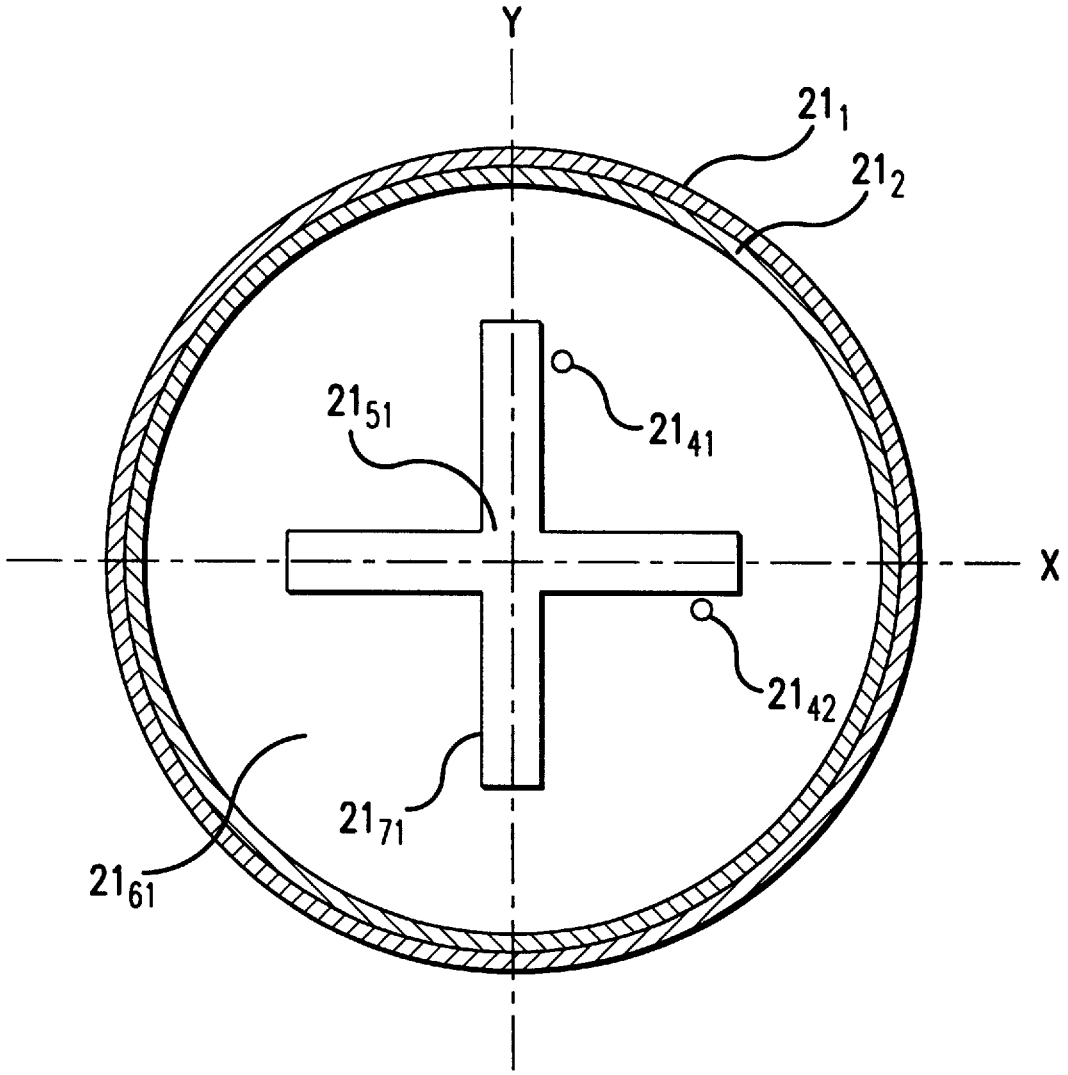
FIG. 13 is a sectional view showing the principal parts of a phase shifting device according to another embodiment of the present invention.

Instead of forming the driver as a microstrip antenna, the driver can also be formed from a slot antenna formed by providing a cross-shaped slot $21_{71}$ in the central portion of metal plate or metal film $21_{61}$ forming the driver element as shown in FIG. 13, which is a sectional view taken along the same line as FIG. 6. Other construction and reference numerals in FIG. 13 are as for FIG. 6.

Figure 14:
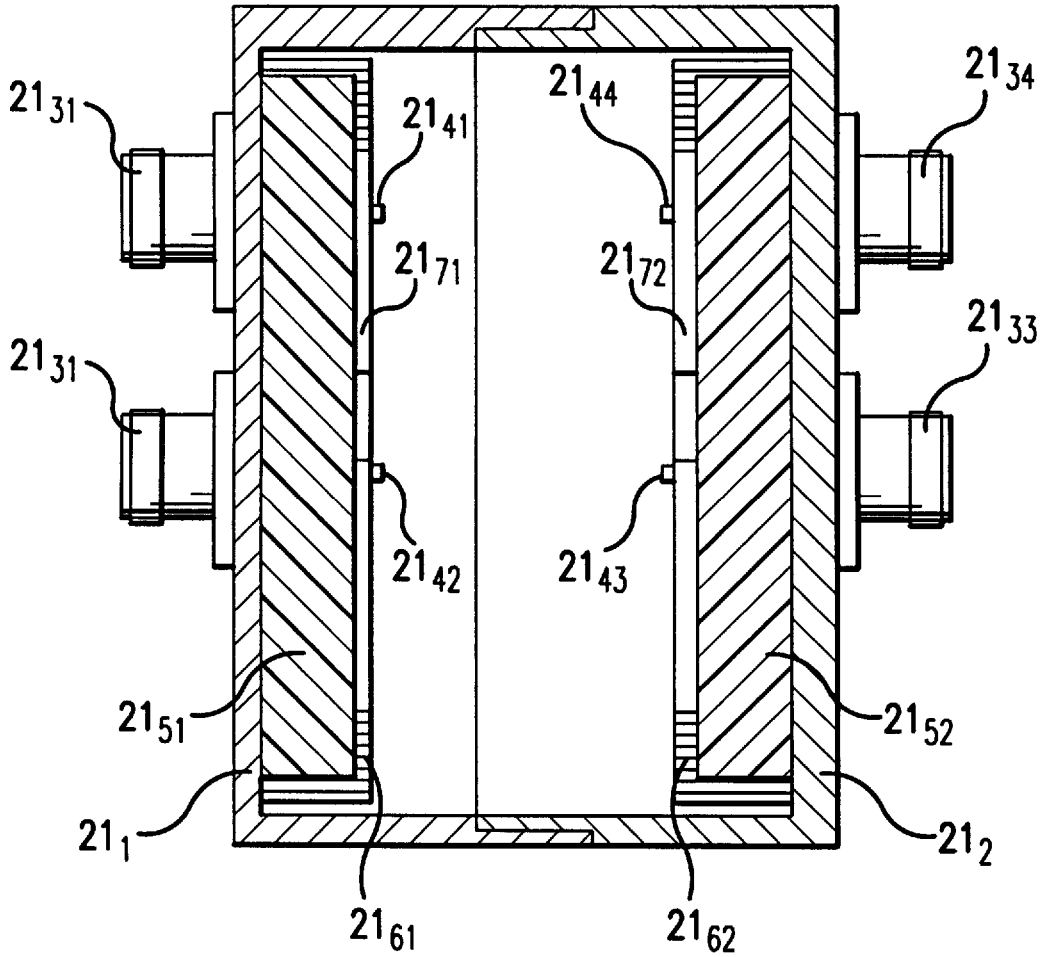
FIG. 14 is a sectional view showing the principal parts of a phase shifting device according to another embodiment of the present invention.

In FIG. 14, which is a sectional view taken along the same line as FIG. 7, $21_{71}$ is cross-shaped slot, and $21_{72}$, like $21_{71}$, is a cross-shaped slot provided in the central portion of the metal plate or metal film $21_{62}$ forming the driver element, the other construction and reference numerals being the same as for FIG. 7.

In this embodiment as well, if sealed cases $21_1$ and $21_2$ are formed by applying a metal film to the outer surface of a base body composed of a suitable synthetic resin, the metal film applied to the outer surface of the base body can serve as the ground conductor and the base body itself can be used as round insulation plates $21_{51}$ and $21_{52}$ of FIG. 14; and if sealed cases $21_1$ and $21_2$ are formed by multilayer stacking of dielectric plates, the first and second drivers composed of slot antennas can be formed by attaching driver elements $21_{61}$ and $21_{62}$ composed of metal films or metal plates provided with cross-shaped slots to the inner surface of each of the bottom walls of sealed cases $21_1$ and $21_2$, and providing a ground conductor on the outer surface of each bottom wall.

Further, probes may be connected to internal conductors $21_{41}$ and $21_{42}$ of coaxial connection plugs $21_{31}$ and $21_{32}$ shown in FIG. 6 or FIG. 13, these probes being formed such that the longitudinal direction of both probes is parallel to metal plate or metal film $21_{61}$, the portions of both probes extending in the longitudinal direction intersect at the center point of metal plate or metal film $21_{61}$, and this intersecting angle is a right angle. A driver composed of probes similar to the sealed case $21_1$ side may then be provided on the sealed case $21_2$ side.

Whichever of the above constructions is adopted for the drivers installed in each of sealed cases $21_1$ and $21_2$, the amount of phase shift between the input and output is determined by the angle of relative rotation between sealed cases $21_1$ and $21_2$, and in order for sealed cases $21_1$ and $21_2$ to rotate with respect to each other, any of the following constructions may be adopted: coaxial cables $26_1$, $26_2$, $27_1$, and $27_2$ are formed as flexible cables; the sealed case $21_2$ side is fixed and sealed case $21_1$, coaxial cables $26_1$ and $26_2$, and 90° 3-dB hybrid circuit 22 rotate as a unit; the sealed case $21_1$ side is fixed and sealed case $21_2$, coaxial cables $27_1$ and $27_2$, and 90° 3-dB hybrid circuit 24 rotate as a unit; or sealed case $21_1$, coaxial cables $26_1$ and $26_2$, and 90° 3-dB hybrid circuit 22 are formed as one rotatable unit and sealed case $21_2$, coaxial cables $27_1$ and $27_2$ and 90° 3-dB hybrid circuit 24 are formed as another rotatable unit.

The foregoing explanations relate to cases in which sealed cases $21_1$ and $21_2$ are each formed as a cylinder with one closed end, but either of sealed case $21_1$ or $21_2$ may be formed as a cylindrical case with one closed end in which is installed either the first or second driver, and the other side, i.e., sealed case $21_2$ or $21_1$ may be formed as a disk-shaped cover with the second or first driver attached to the inner surface, this cover being formed to rotatably fit with the end portion of the opening of the closed cylinder body.

Figure 15:
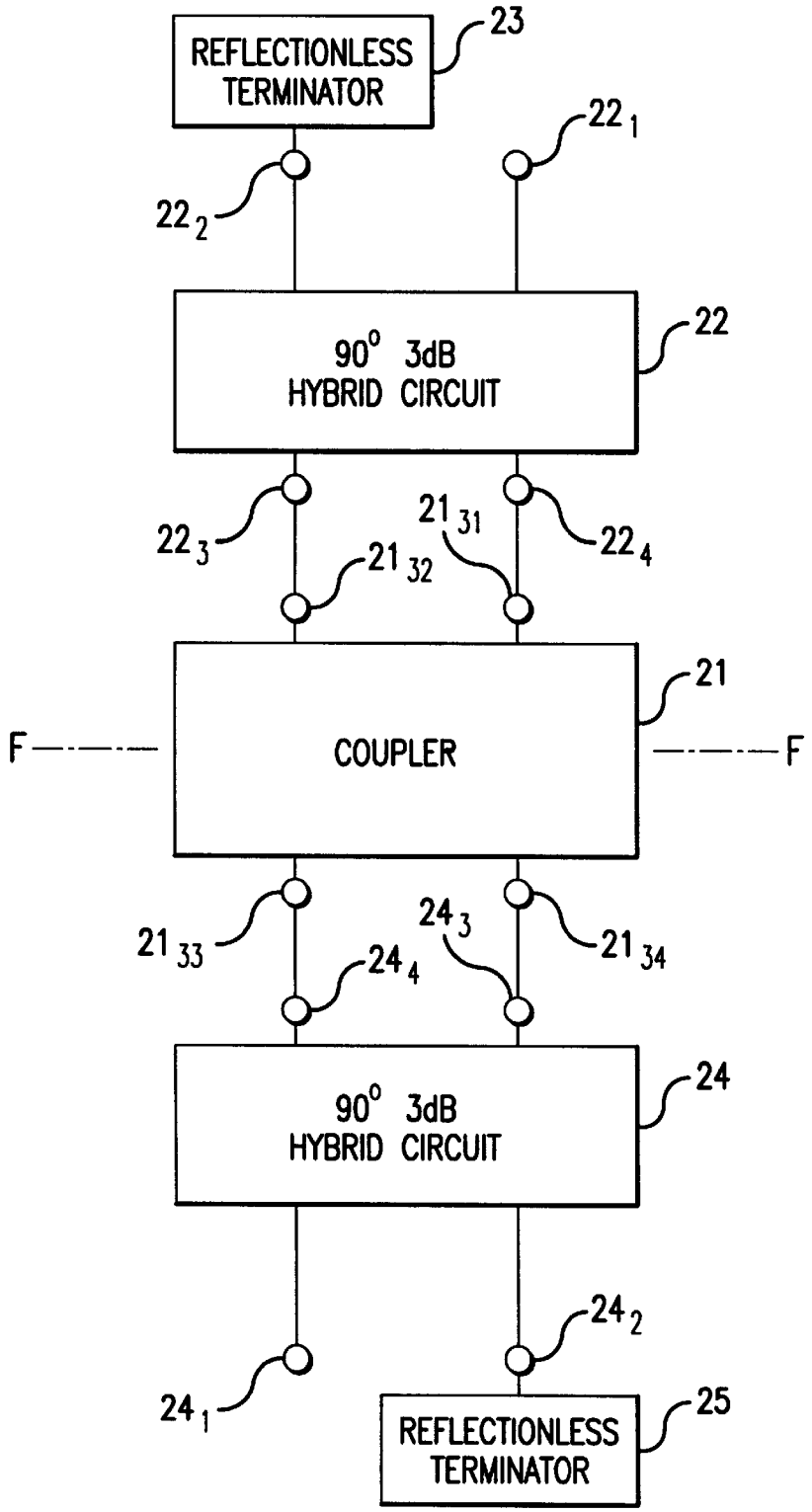
FIG. 15 is a block diagram showing a phase shifting device according to the embodiment of FIG. 13.

As is clear from the foregoing explanation, in this phase shifting device, the side of coaxial cables $26_1$ and $26_2$ and 90° 3-dB hybrid circuit 22 and the side of coaxial cables $27_1$ and $27_2$ and 90° 3-dB hybrid circuit 24 are formed symmetrically to each other across the plane cutting through the midsection of the coupler 21 at F—F in FIG. 15; and consequently, precisely identical operation can be achieved as explained in conjunction with FIG. 8 even if terminal $24_1$ of 90° 3-dB hybrid circuit 24 is made the input terminal and terminal $22_1$ of 90° 3-dB hybrid circuit 22 is made the output terminal. The other reference numerals of FIG. 15 are equivalent to those of FIG. 3.

The foregoing explanation relates to an example (see FIG. 8) in which 90° 3-dB hybrid circuits 22 and 24 and reflectionless terminators 23 and 25 have been used for the two-partition circuit of the input and the combining circuit of the output, but for a case in which the transmission frequency bandwidth is relatively narrow, the input-and output-side 90° 3-dB hybrid circuits 22 and 24 and reflectionless terminators 23 and 25 can be replaced by two-branch terminal circuits, with one of coaxial cables $26_1$ and $26_2$ connecting coaxial connection plugs $21_{31}$ and $21_{32}$ of coupler 21 with the two output terminals of the two-branch terminal circuit on the input side, for example, coaxial cable $26_2$, being formed exactly one transmission quarter-wavelength longer than coaxial cable $26_1$, and one of coaxial cables $27_1$ and $27_2$ connecting coaxial connection plugs $21_{33}$ and $21_{34}$ of coupler 21 to the two input terminals of the two-branch terminal circuit on the output side, for example coaxial cable $27_1$, being formed exactly one transmission quarter-wavelength longer than coaxial cable $27_2$.

In this embodiment, although the lengths of coaxial cables $26_1$ and $26_2$ must be made to differ by exactly one transmission quarter-wavelength, and the lengths of coaxial cables $27_1$ and $27_2$ similarly must be made to differ by exactly one transmission quarter-wavelength, the difference in lengths for both sets of cables is fixed at one transmission quarter-wavelength, and fabrication is therefore relatively easy.

If the difference in lengths between coaxial cables $26_1$ and $26_2$ and the difference in lengths between coaxial cables $27_1$ and $27_2$ is selected to be one quarter-wave-length of the center frequency of the transmission band, the difference in length between the coaxial cables will not precisely match the quarter-wavelength for frequencies outside the center frequency, but since this embodiment is intended for applications in which the transmission frequency band is relatively narrow, any operational error arising due to variance from the quarter-wavelength is minute and presents no practical problem.

The foregoing explanation relates to a case in which the phase shifting device of the present invention is constructed by assembling three-dimensional constituent elements, but the entire structure can be miniaturized by forming 90° 3-dB hybrid circuits 22 and 24 and reflectionless terminators 23 and 25 on a printed circuit board using a printed wiring method, and forming coaxial cables $26_1$, $26_2$, $27_1$ and $27_2$ as microstrip wiring.

The entire structure may also be made extremely compact and concise by providing dielectric layers on the outer surfaces of sealed cases $21_1$ and $21_2$ of coupler 21, and then forming by a printed wiring method on the dielectric layer provided on the outer surface of sealed case $21_1$ microstrip wiring that takes the place of 90° 3-dB hybrid circuit 22, reflectionless terminator 23 and coaxial cables $26_1$ and $26_2$, and forming by a printed wiring method on the dielectric layer provided on the outer surface of sealed case $21_2$ microstrip wiring that takes the place of 90° 3-dB hybrid circuit 24, reflectionless terminator 25 and coaxial cables $27_1$ and $27_2$.

In a case in which two-branch terminal circuits are used in place of 90° 3-dB hybrid circuits 22 and 24 and reflectionless terminators 23 and 25, the entire structure can be miniaturized through formation on printed circuit boards or on dielectric layers provided on the outer surfaces of each of sealed cases $21_1$ and $21_2$.

Figure 16:
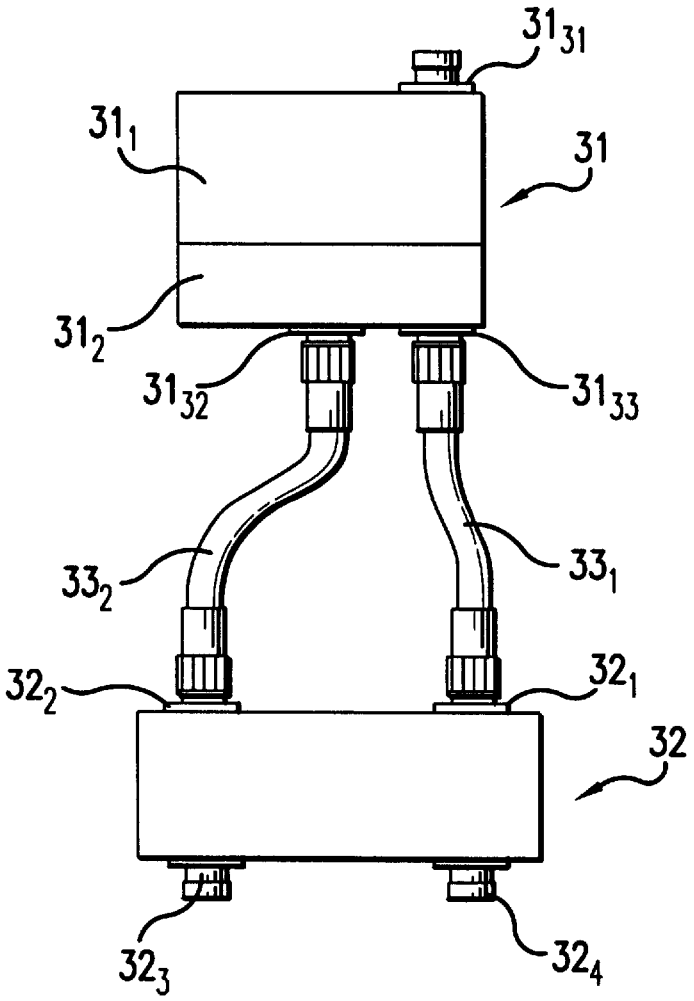
FIG. 16 is a side view of a phase shifting device according to another embodiment of the present invention.

FIG. 16 presents a phase shifting device according to another embodiment of the present invention.

The phase shifting device of this embodiment is constructed from a coupler 31 composed of cylindrical sealed cases $31_1$ and $31_2$ having one closed end, and terminals $31_{31}$–$31_{33}$ composed of, for example, coaxial connection plugs; 90° 3-dB hybrid circuit 32 composed of, for example, a quarter-wave coupled line-type directional coupler including input terminal $32_1$, isolation terminal $32_2$, and output terminals $32_3$ and $32_4$; coaxial cable $33_1$ connecting terminal $31_{33}$ and input terminal $32_1$; and coaxial cable $33_2$ connecting terminal $31_{32}$ and isolation terminal $32_2$. Here, considering a signal inputted to input terminal $32_1$, the phase of the output from output terminal $32_3$ is delayed substantially 90° with respect to the phase of the output of output terminal $32_4$. In addition, the length of each of coaxial cable $33_1$ and $33_2$ is adjusted such that the phase difference between inputs at the input end of each of coaxial cables $33_1$ and $33_2$ is maintained unchanged when outputted from the output end of each of coaxial cables $33_1$ and $33_2$.

Figure 17:
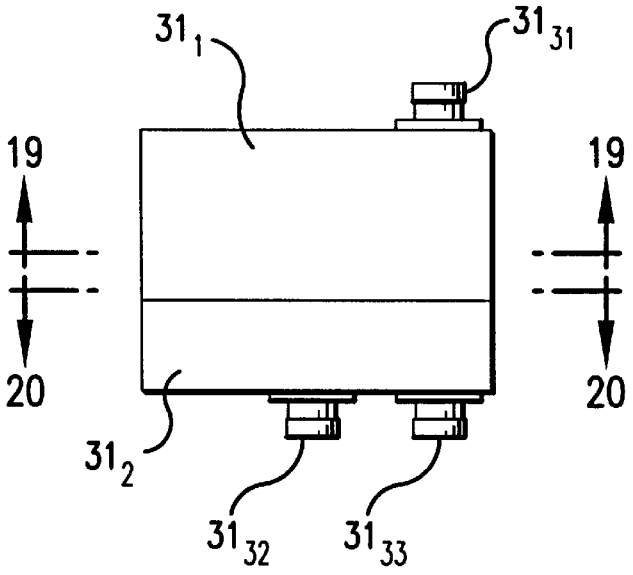
FIG. 17 is a side view of coupler 31 within FIG. 16.
Figure 18:
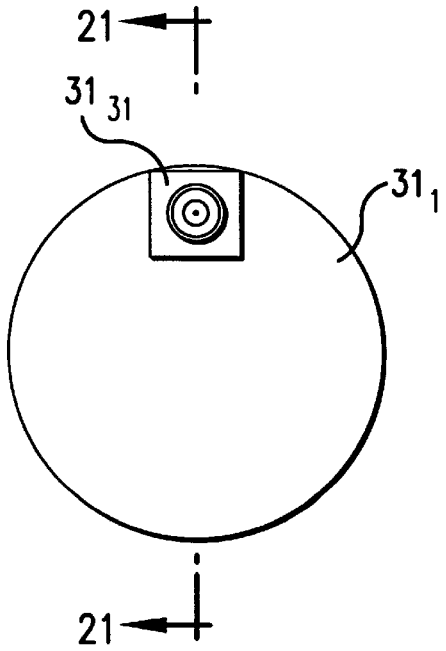
FIG. 18 is a plan view of coupler 31 within FIG. 16.
Figure 19:
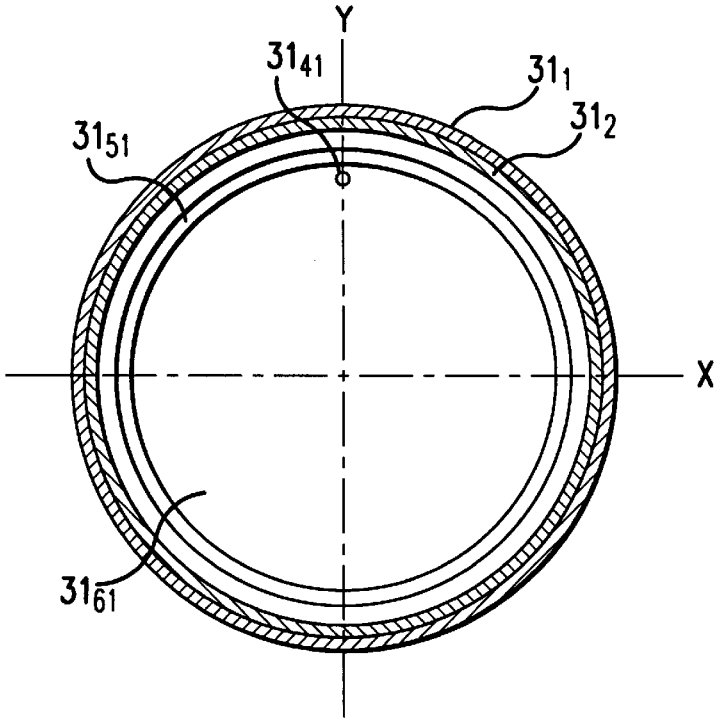
FIG. 19 is a sectional view taken at line G—G of FIG. 17.
Figure 20:
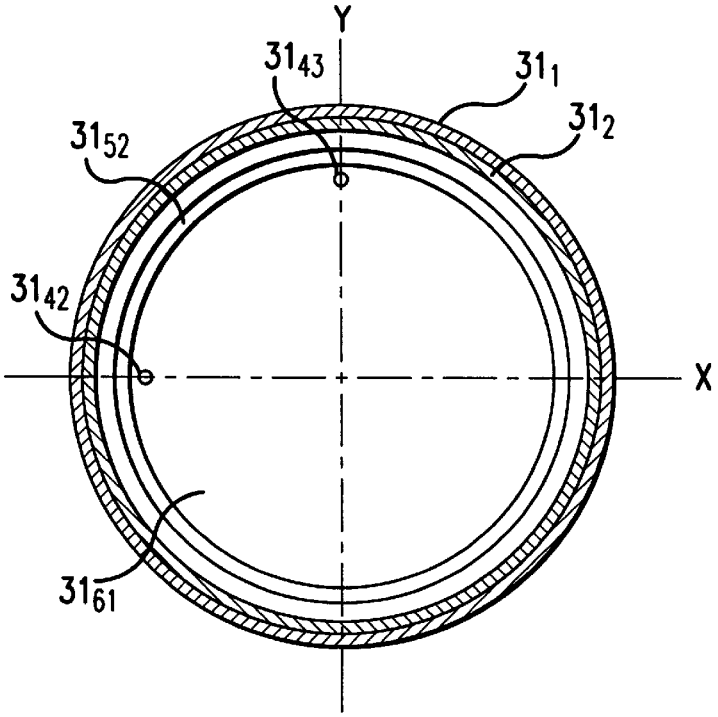
FIG. 20 is a sectional view taken at line H—H of FIG. 17.

FIG. 17 shows a side view of coupler 31 of FIG. 16, and FIG. 18 shows a plan view of the sealed case $31_1$ side of coupler 31 as seen from the side of the bottom wall, the reference numerals used in FIGS. 17 and 18 being the same as those used in FIG. 16. FIG. 19 is an enlarged sectional view taken at line G—G of FIG. 16, FIG. 20 is an enlarged sectional view taken at line H—H of FIG. 17, and FIG. 21 is an enlarged sectional view taken at line I—I of FIG. 18.

Figure 21:
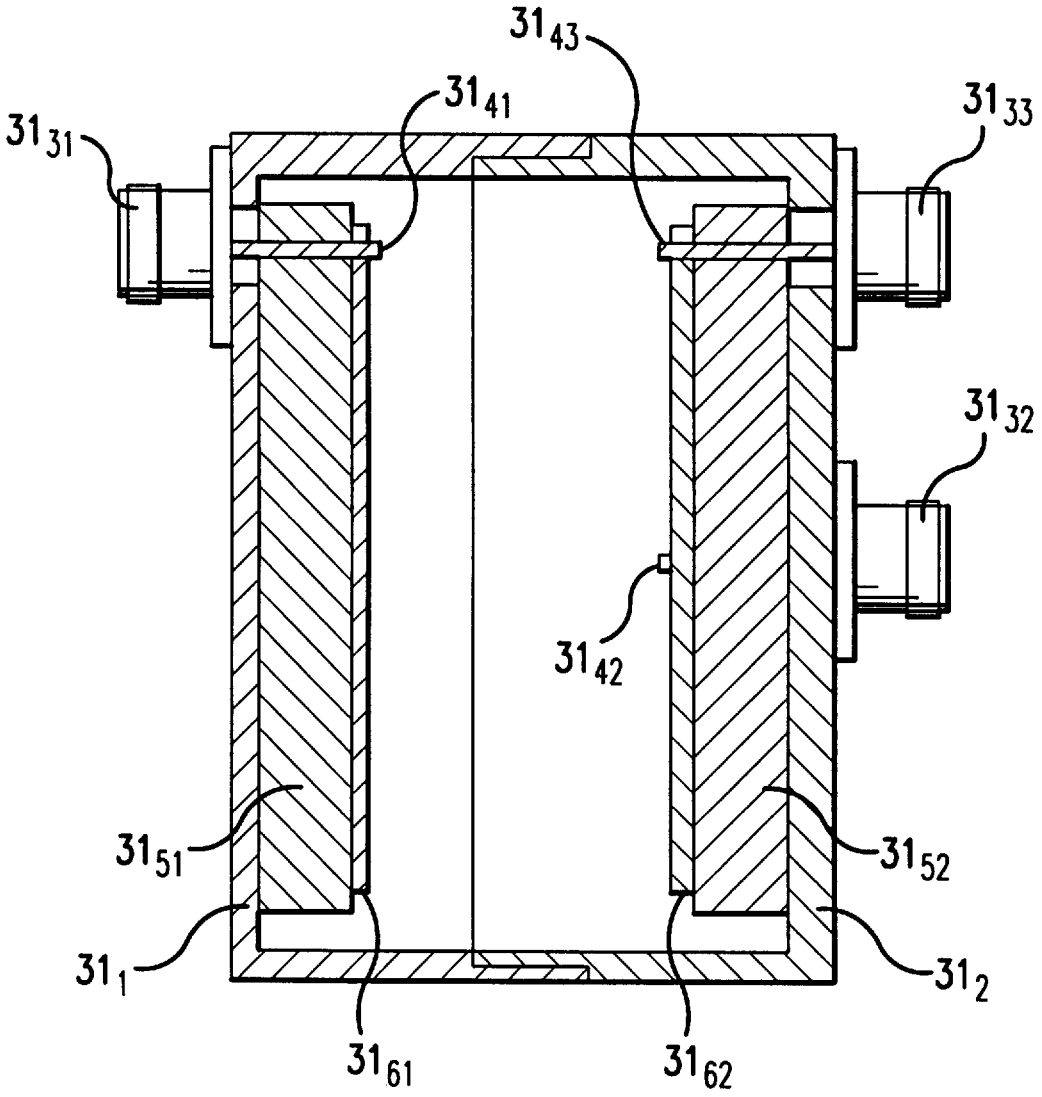
FIG. 21 is a sectional view taken at line I—I of FIG. 18.

As can be clearly seen from FIG. 21, stepped portions are formed in the side walls at the end portions of the openings of each of sealed cases $\mathbf{31}_1$ and $\mathbf{31}_2$, the end portion of the opening of one of the sealed cases, in this case sealed case $\mathbf{31}_2$, fitting inside the end portion of the opening of the other sealed case $\mathbf{31}_1$, the two sealed cases $\mathbf{31}_1$ and $\mathbf{31}_2$ being mechanically and electrically coupled, and sealed cases $\mathbf{31}_1$ and $\mathbf{31}_2$ able to rotate relative to each other around their cylindrical axis.

Sealed cases $\mathbf{31}_1$ and $\mathbf{31}_2$ are manufactured by machining a metal block or press-forming a metal sheet in the prescribed shape; by forming a suitable synthetic resin in a preliminary form of the prescribed shape and subsequently applying a metal film to the surface by an electroless plating or vacuum evaporation process; or by multilayer stacking of dielectric plates having an appropriate dielectric constant and forming as a cylinder with one closed end that shields electromagnetic energy in accordance with Snell's law.

Coaxial connection plugs $\mathbf{31}_{31}$ to $\mathbf{31}_{33}$ have internal conductors $\mathbf{31}_{41}$ to $\mathbf{31}_{43}$. Round insulation plates $\mathbf{31}_{51}$ and $\mathbf{31}_{52}$ are composed of a material having excellent high-frequency characteristics such as an organic material such as polyethylene or fluorinated ethylene or an inorganic material such as a ceramic and have a thickness less than the transmission wavelength, round insulation plate $\mathbf{31}_{51}$ being secured to the inner surface of the bottom wall of sealed case $\mathbf{31}_1$, round insulation plate $\mathbf{31}_{52}$ being secured to the inner surface of the bottom wall of sealed case $\mathbf{31}_2$, and each being secured using a suitable adhesive.

Metal plate $\mathbf{31}_{61}$ is secured to the surface of round insulation plate $\mathbf{31}_{51}$ using a suitable adhesive, and in addition, a portion of its periphery is electrically connected to internal conductor $\mathbf{31}_{41}$ of coaxial connection plug $\mathbf{31}_{31}$. First driver composed of a microstrip antenna is formed with sealed case $\mathbf{31}_1$ on the opposing side of insulation plate $\mathbf{31}_{51}$ serving as ground conductor, metal plate $\mathbf{31}_{61}$ serving as first driver element, and the connection point between internal conductor $\mathbf{31}_{41}$ of coaxial connection plug $\mathbf{31}_{31}$ and metal plate $\mathbf{31}_{61}$ serving as the driver point.

Metal plate $\mathbf{31}_{62}$ is secured to the surface of round insulation plate $\mathbf{31}_{52}$ using a suitable adhesive, and in addition, portions of its periphery are electrically connected to internal conductors $\mathbf{31}_{42}$ and $\mathbf{31}_{43}$ of coaxial connection plugs $\mathbf{31}_{32}$ and $\mathbf{31}_{33}$. Second driver composed of a microstrip antenna is formed with sealed case $\mathbf{31}_2$ on the opposing side of insulation plate $\mathbf{31}_{52}$ serving as ground conductor, metal plate $\mathbf{31}_{62}$ serving as second driver element, and the connection points between metal plate $\mathbf{31}_{62}$ and internal conductors $\mathbf{31}_{42}$ and $\mathbf{31}_{43}$ of coaxial connection plugs $\mathbf{31}_{32}$ and $\mathbf{31}_{33}$ serving as the driver points.

As can be seen from FIG. 20, a right angle is formed by the intersection of the straight line joining the center of metal plate $\mathbf{31}_{62}$ with the driving point composed of the connection point between internal conductor $\mathbf{31}_{42}$ of coaxial connection plug $\mathbf{31}_{32}$ and metal plate $\mathbf{31}_{62}$, and the straight line joining the center of metal plate $\mathbf{31}_{62}$ with the driving point formed by the connection point between internal conductor $\mathbf{31}_{43}$ of coaxial connection plug $\mathbf{31}_{33}$ and metal plate $\mathbf{31}_{62}$.

In addition, the spacing between first driver element $\mathbf{31}_{61}$ and second driver $\mathbf{31}_{62}$ is set at less than the transmission wavelength.

The external conductor of coaxial connection plug $\mathbf{31}_{31}$ is electrically connected to sealed case $\mathbf{31}_1$, and the external conductors of each of coaxial connection plugs $\mathbf{31}_{32}$ and $\mathbf{31}_{33}$ are connected to sealed case $\mathbf{31}_2$; but, as shown in FIG. 21, a gap is provided by removing a portion of the sealed case $\mathbf{31}_1$ in the vicinity of internal conductor $\mathbf{31}_{41}$ and a gap is provided by removing a portion of sealed case $\mathbf{31}_2$ in the vicinity of internal conductor $\mathbf{31}_{43}$ such that internal conductors $\mathbf{31}_{41}$ and $\mathbf{31}_{43}$ of coaxial connection plugs $\mathbf{31}_{31}$ and $\mathbf{31}_{33}$ do not mechanically contact sealed cases $\mathbf{31}_1$ and $\mathbf{31}_2$. Although not shown in FIG. 21, a gap is similarly provided in sealed case $\mathbf{31}_2$ in the vicinity of internal conductor $\mathbf{31}_{42}$ of coaxial connection plug $\mathbf{31}_{21}$.

Rather than using an adhesive as a means of securing metal plate $\mathbf{31}_{61}$ or $\mathbf{31}_{62}$ to the surface of round insulation plate $\mathbf{31}_{51}$ or $\mathbf{31}_{52}$, the center of metal plate $\mathbf{31}_{61}$ or $\mathbf{31}_{62}$ (the portion where electric field intensity is 0) may be secured to round insulation plate $\mathbf{31}_{51}$ or $\mathbf{31}_{52}$ using a setscrew, or alternatively the center of metal plate $\mathbf{31}_{61}$ or $\mathbf{31}_{62}$ may be screwed to the bottom wall of sealed case $\mathbf{31}_1$ or $\mathbf{31}_2$ through round insulation plate $\mathbf{31}_{51}$ or $\mathbf{31}_{52}$.

Rather than forming the driver element of the microstrip antenna constituting the first or second driver from metal plate $\mathbf{31}_{61}$ or $\mathbf{31}_{62}$, the driver element may be formed by applying a metal film to the surface of round insulation plate $\mathbf{31}_{51}$ or $\mathbf{31}_{52}$ using a vacuum evaporation process and finishing to the required outline shape by a process such as etching.

Whether the driver element is formed from a metal plate or metal film, its outline shape may be formed as a square instead of the circle shown in FIG. 19 and FIG. 20.

Regarding the dimensions of driver elements $\mathbf{31}_{61}$ and $\mathbf{31}_{62}$ for cases in which driver elements $\mathbf{31}_{61}$ and $\mathbf{31}_{62}$ are driven in basic mode, if the outline shape of these elements is formed as a circle, the specific inductive capacity of round insulation plates $\mathbf{31}_{51}$ and $\mathbf{31}_{52}$ is $\epsilon_r$ and the design frequency is $f_o$, the radius of driver elements $\mathbf{31}_{61}$ and $\mathbf{31}_{62}$ is preferably selected to be substantially $1.841\ C/(2\pi.\ f_o.\ \epsilon_r^{1/2})$; and if the outline shape of driver elements $\mathbf{31}_{61}$ and $\mathbf{31}_{62}$ is formed as a square, the length of one side is preferably selected to be substantially $C/(2f_o.\ \epsilon_r^{1/2})$ (where C is the speed of light).

Figure 22A:
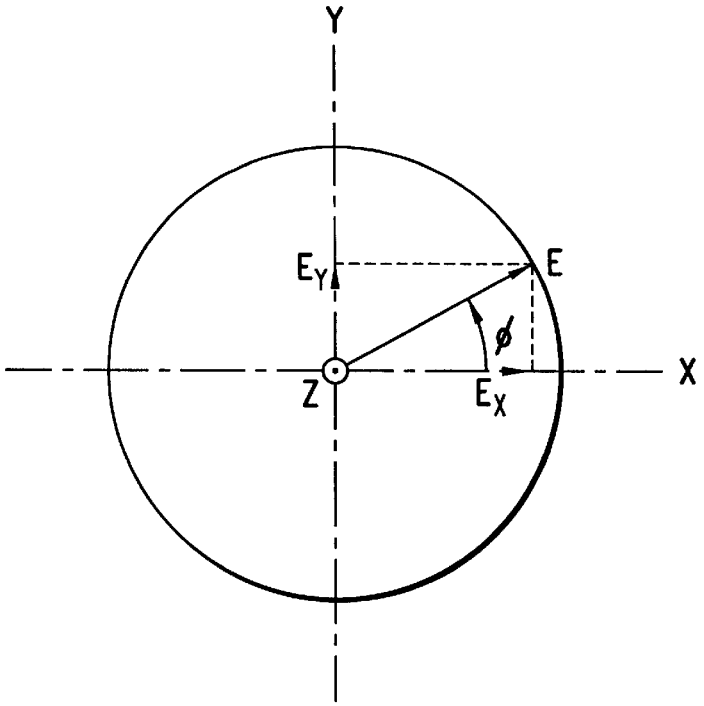
FIGS. 22A and 22B show the electric field level produced by drive element 31 and the outputs $E_1$ and $E_2$ of 90° 3-dB hybrid circuit 32 in the phase shifting device of FIG. 16.
Figure 22B:
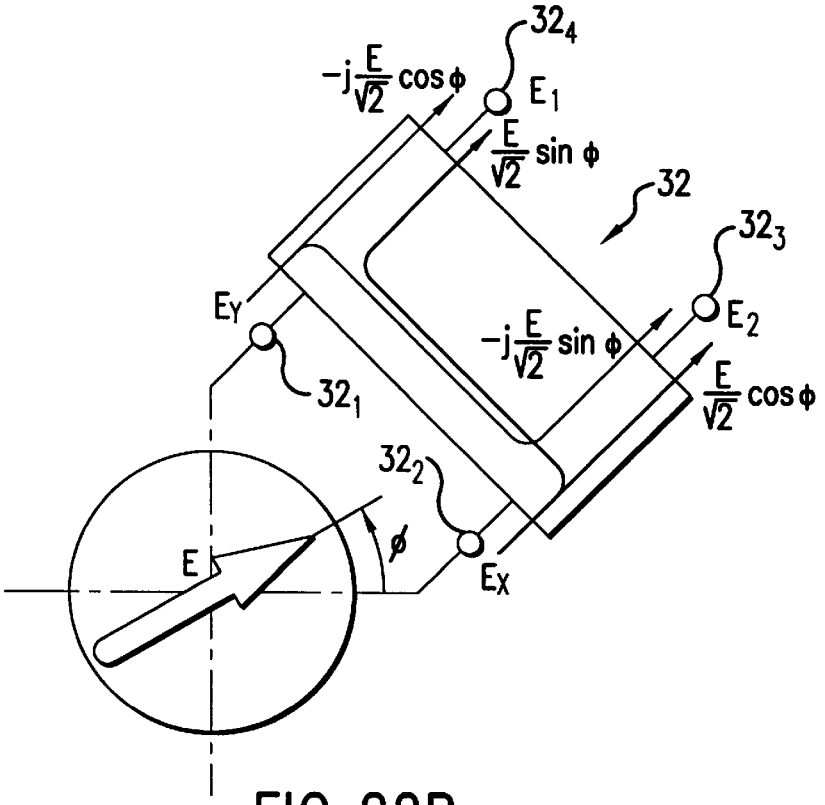

FIG. 22 illustrates the operation of the present phase shifting device.

As FIG. 21 illustrates, the input applied to coaxial connection plug $\mathbf{31}_{31}$ of coupler 31 passes through internal conductor $\mathbf{31}_{41}$ and drives driver element $\mathbf{31}_{61}$ in the first driver.

If the X-axis and Y-axis are established as shown in FIG. 19, FIG. 20, and FIG. 22A, electric field vector E produced by driver element $\mathbf{31}_{61}$ driven as described above can be divided between two orthogonal components $E_X$ and $E_Y$ as shown in FIG. 22A. These couple at driver element $\mathbf{31}_{62}$ of the second driver in the form:

$$E=E_X+E_Y=E\cos\phi+\sin\phi$$

As described hereinabove, this device is formed such that a right angle is formed by the intersection of the straight line joining the center of driver element $\mathbf{31}_{62}$ with the driving point constituted by the connection point between driver element $\mathbf{31}_{62}$ and internal conductor $\mathbf{31}_{42}$ of coaxial connection plug $\mathbf{31}_{32}$ and the straight line joining the center of driver element $\mathbf{31}_{62}$ with the driving point constituted by the connection point between driver element $\mathbf{31}_{62}$ and internal element $\mathbf{31}_{43}$ of coaxial connection plug $\mathbf{31}_{33}$; and therefore, when driver element $\mathbf{31}_{62}$ is driven in basic mode, coupling between coaxial connection plugs $\mathbf{31}_{32}$ and $\mathbf{31}_{33}$ becomes sparse and quadrature mode coupling is enabled.

The quadrature mode coupling to driver element $\mathbf{31}_{62}$ causes component $E_X$ to be outputted from coaxial connection plug $\mathbf{31}_{32}$ and component $E_Y$ to be outputted from coaxial connection plug $\mathbf{31}_{33}$, the two outputs being respectively inputted to terminals $32_1$ and $32_2$ of 90° 3-dB hybrid circuit 32 by way of coaxial cables $33_1$ and $33_2$.

If the output of output terminals $32_4$ and $32_3$ of 90° 3-dB hybrid circuit 32 are $E_1$ and $E_2$, respectively:

$$E_1 = \frac{E}{\sqrt{2}}\sin\phi - j\frac{E}{\sqrt{2}}\cos\phi = \frac{E}{\sqrt{2}}e^{-j\{(\pi/2)-\phi\}}$$

$$E_2 = \frac{E}{\sqrt{2}}\cos\phi - j\frac{E}{\sqrt{2}}\phi = \frac{E}{\sqrt{2}}e^{-j\pi}$$

Although the phase of output $E_1$ shifts in a counterclockwise direction with increase in declination angle $\phi$ of electric field vector E from the X-axis as shown in FIG. 22A, the amplitude remains unchanged. The phase of output $E_2$ also shifts in a clockwise direction with increase in declination angle $\phi$ of electric field vector E from the X-axis, but again, the amplitude remains unchanged. Accordingly, if the declination angle $\phi$ of electric field vector E from the X-axis is 45° or 225°, the amplitude as well as the phase of both outputs $E_1$ and $E_2$ are equal, but if the declination angle $\phi$ increases from 45° or 225°, the phase of output $E_1$ shifts in the advance direction, and the phase of output $E_2$ shifts in the delay direction. If the declination angle $\phi$ of electric field vector E from the X-axis further increases to 135° or 315°, the phase relation between outputs $E_1$ and $E_2$ is mutually reversed.

Figure 23:
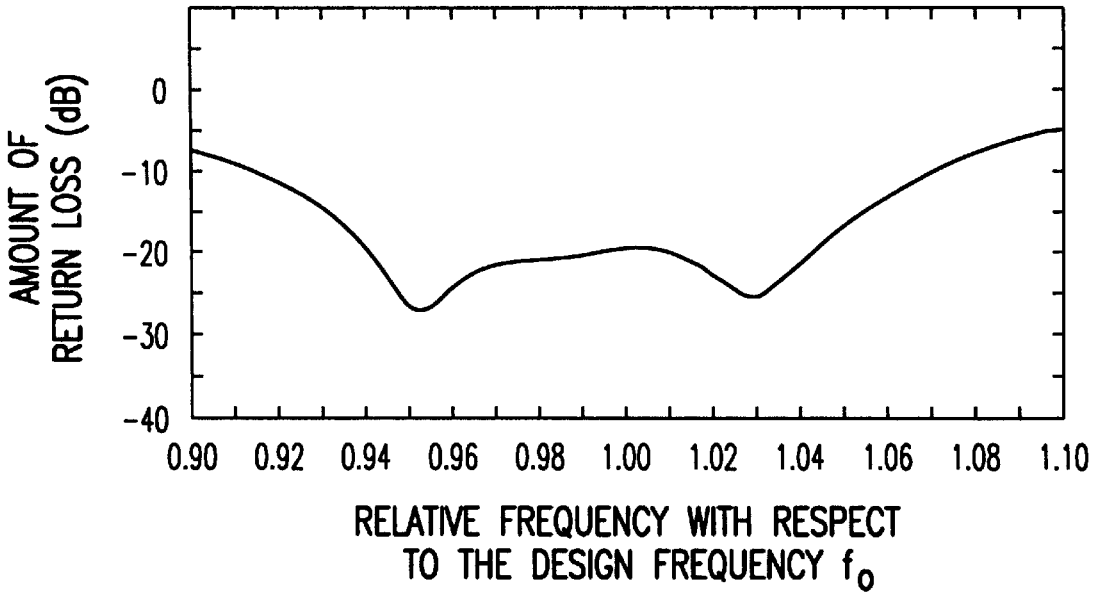
FIG. 23 shows the reflection characteristic in coaxial connection plug $\mathbf{31}_{31}$ of the phase shifting device of FIG. 16.
Figure 24:
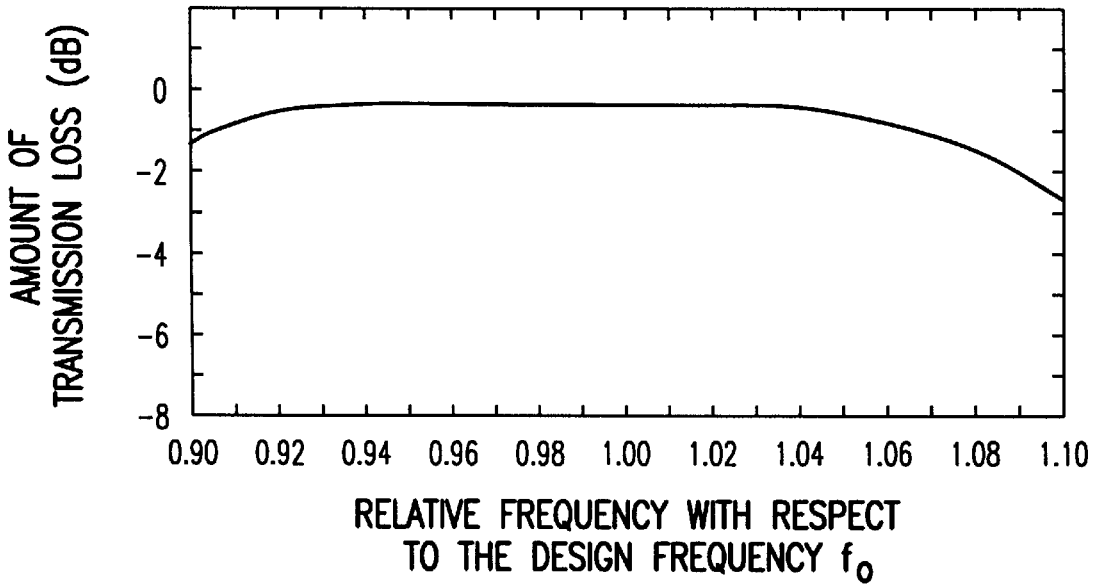
FIG. 24 shows the transmission loss characteristic between coaxial connection plugs $\mathbf{31}_{31}$ and $\mathbf{31}_{33}$ of the phase shifting device of FIG. 16.

FIG. 23 shows the reflection characteristic at coaxial connection plug $31_{31}$ observed after removing coaxial cables $33_1$ and $33_2$ from coaxial connection plugs $31_{32}$ and $31_{33}$, (see FIG. 21 regarding the following dimensions) the inner diameter of the cylinders with one closed end forming sealed cases $31_1$ and $31_2$ of coupler 31 being selected as 0.285 $\lambda_o$ ($\lambda_o$ being the free-space wavelength corresponding to the design frequency $f_o$), the distance of opposition between the bottom wall of sealed case $31_1$ and the bottom wall of sealed case $31_2$ as 0.089 $\lambda_o$, the specific inductive capacity of round insulation plates $31_{51}$ and $31_{52}$ as 10, the dielectric dissipation factor of each of round insulation plates $31_{51}$ and $31_{52}$ as 0.0055, the thickness of each of round insulation plates $31_{51}$ and $31_{52}$ as 0.023 $\lambda_o$, the outline shape of first and second driver elements $31_{61}$ and $31_{62}$ being formed as a circle with a diameter of 0.21 $\lambda_o$, the axis of abscissas in the figure being the relative frequency for the design frequency $f_o$, and the axis of ordinates being the amount of return loss (dB). FIG. 24 shows the transmission characteristics between coaxial connection plugs $31_{31}$ and $31_{33}$ observed with coaxial cable $31_1$ and $33_2$ removed from coaxial connection plugs $31_{32}$ and $31_{33}$ and the selected values of the dimensions of each of the parts of coupler 31 being the same as described for FIG. 23, the horizontal axis of the figure being the same as for FIG. 23 and the vertical axis being the amount of transmission loss (dB).

As is clear from FIG. 23 and FIG. 24, coupler 31 exhibits excellent reflection characteristics and transmission characteristics across a broad band.

In addition, the thickness of round insulation plates $31_{51}$ and $31_{52}$ in coupler 31 can be selected according to the transmission frequency band, and the bandwidth can be broadened by increasing the selected thickness.

Figure 25:
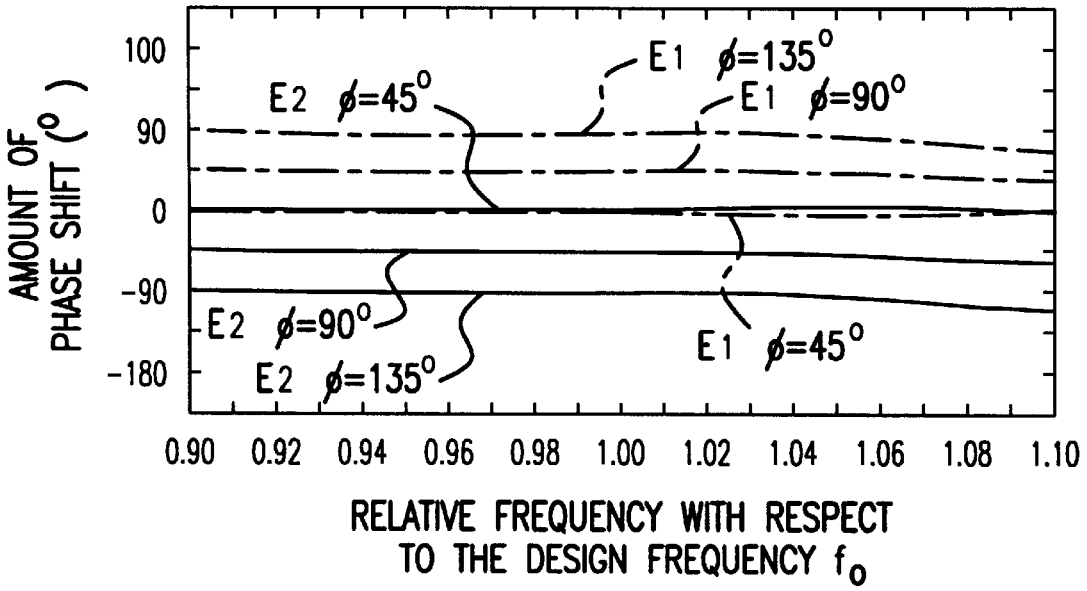
FIG. 25 shows the degree of phase shift in relation to the relative angle of rotation $\phi$ between sealed cases $\mathbf{31}_1$ and $\mathbf{31}_2$ in the phase shifting device of FIG. 16.

FIG. 25 shows the results of observing the phase shift of output $E_1$ of coaxial connection plug $31_{33}$ and output $E_2$ of coaxial connection plug $31_{32}$ upon change of declination angle $\phi$ to 90° or 135° with 45° as a standard. Here, the same values are selected for the dimensions of each part of coupler 31 as described for FIG. 23; the phase shifting device is configured as shown in FIG. 16, wherein 90° 3-dB hybrid circuit 32 is connected to coupler 31 by way of coaxial cables $33_1$ and $33_2$; and sealed cases $31_1$ and $31_2$, which make up coupler 31, are rotated relative to each other around their common cylindrical axis. The angle of declination $\phi$ is formed by the straight line joining the center of driver element $31_{62}$ with the connection point between internal conductor $31_{42}$ of coaxial connection plug $31_{32}$ and driver element $31_{62}$ in the second driver installed on the sealed case $31_2$ side, i.e., the X-axis, and the electric field vector E arising due to drive of driver element $31_{61}$ in the first driver installed on the sealed case $31_1$ side. For both outputs $E_1$ and $E_2$, the absolute value of the change in phase and the change in declination angle $\phi$ match without any dependence on transmission frequency, and the signs of phases of outputs $E_1$ and $E_2$ differ. Accordingly, the phase difference between outputs $E_1$ and $E_2$ with respect to change in declination angle $\phi$ is 2 $\phi$.

The axis of abscissas of FIG. 25 is the same as for FIG. 23, and the axis of ordinates shows declination angle $\phi$, i.e., the amount of phase shift (°) with respect to the relative angle of rotation $\phi$ between sealed cases $31_1$ and $31_2$.

Figure 26:
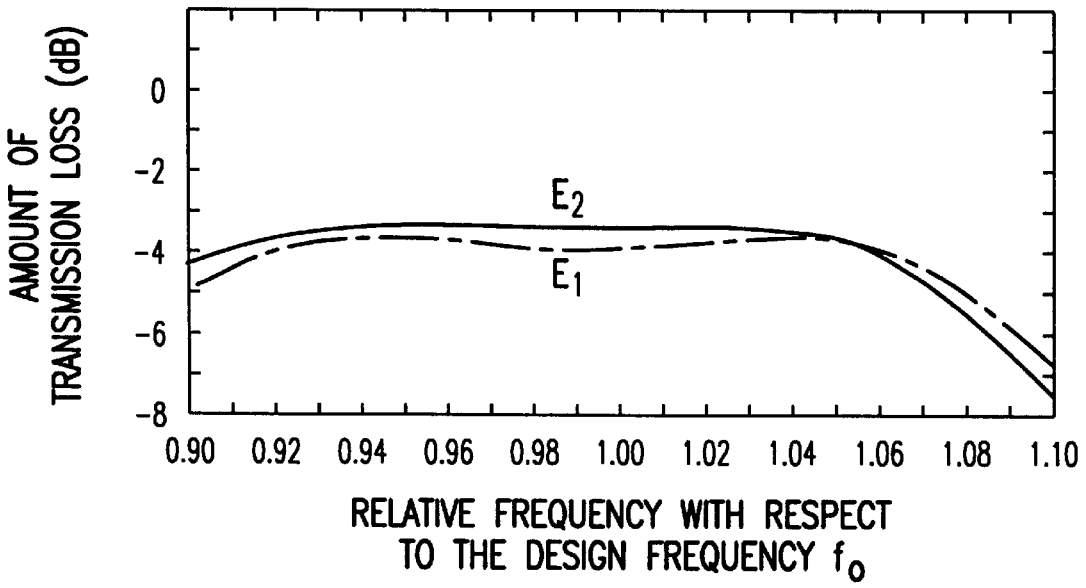
FIG. 26 shows the observation results of the transmission loss between coaxial connection plug $\mathbf{31}_{31}$ of coupler 31 and the output terminal $\mathbf{32}_3$ of 90° 3-dB hybrid circuit 32, and between coaxial connection plug $\mathbf{31}_{31}$ of coupler 31 and output terminal $\mathbf{32}_4$ of 90° 3-dB hybrid circuit 32.

FIG. 26 shows the amount of transmission loss between coaxial connection plug $31_{31}$ of coupler 31 and output terminal $32_3$ of 90° 3-dB hybrid circuit 32, and between coaxial connection plug $31_{31}$ of coupler 31 and output terminal $32_4$ of 90° 3-dB hybrid circuit 32, the observation results being obtained under the same conditions as those for FIG. 25, the axis of abscissas being the same as FIG. 25 and the axis of ordinates showing the amount of transmission loss (dB).

As is clear from FIG. 26, although the addition of 90° 3-dB hybrid circuit 32 and coaxial cables $33_1$ and $33_2$ results in increased transmission loss as compared with the amount of transmission loss for the case shown in FIG. 24 in which coupler 31 alone is used, the differences in the change of phase shift of outputs $E_1$ and $E_2$ with respect to the change in angle $\phi$ or in amplitude of outputs $E_1$ and $E_2$ are virtually negligible.

Figure 27:
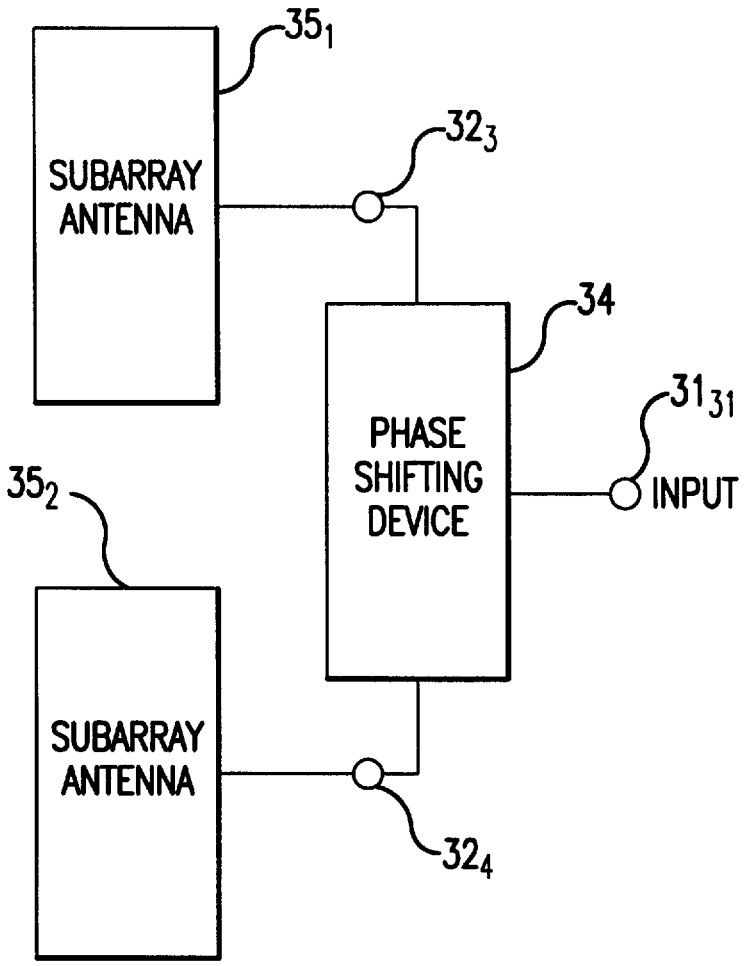
FIG. 27 shows an example of the use of both outputs $E_2$ and $E_1$ of output terminals $\mathbf{32}_3$ and $\mathbf{32}_4$ of 90° 3-dB hybrid circuit 32.

FIG. 27 shows an example which employs both outputs $E_2$ and $E_1$ of output terminals $32_3$ and $32_4$ of 90° 3-dB hybrid circuit 32. Reference numeral 34 indicates the phase shifting device shown in FIG. 16, $31_{31}$ is the input terminal of coupler 31 in phase shifting device 34, $32_3$ and $32_4$ are the output terminals of 90° 3-dB hybrid circuit 32 in phase shifting device 34, and $35_1$ and $35_2$ are both subarray antennas composed of a plurality of element antennas.

The locus joining the peaks of each of output vectors $E_X$ and $E_Y$ corresponding to the change in the relative angle of rotation $\phi$ between sealed cases $31_1$ and $31_2$ which make up coupler 31 in phase shifting device 34 is an oval, but the angle at which output vectors $E_X$ and $E_Y$ begin to describe an oval both differs by 90° and is in the opposite direction of rotation, and consequently, the phase difference between outputs $E_2$ and $E_1$ can be freely selected. Accordingly, the direction of maximum radiation and the side-lobe characteristics of the array antenna composed of subarray antennas $35_1$ and $35_2$ can be controlled by supplying outputs $E_2$ and $E_1$ of output terminals $32_3$ and $32_4$ as the driving power of subarray antennas $35_1$ and $35_2$.

Figure 1A:
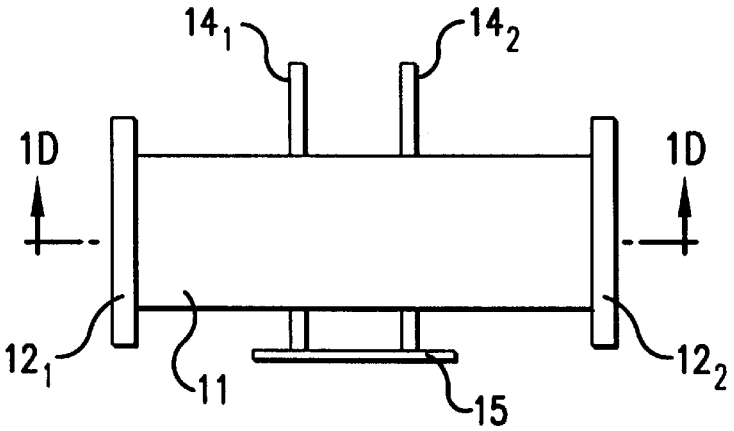
FIG.1A PRIOR ART
FIGS. 1A, 1B, 1C and 1D show an example of a waveguide-type phase shifting device of the prior art.
Figure 1B:
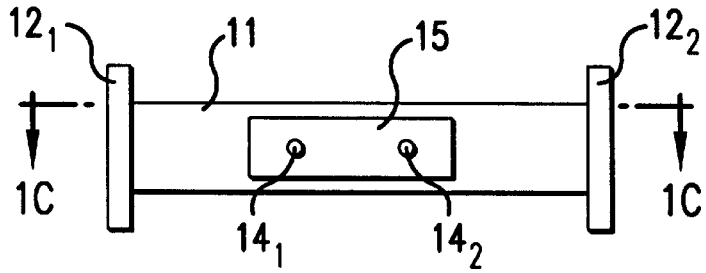
FIG.1B PRIOR ART
Figure 1C:
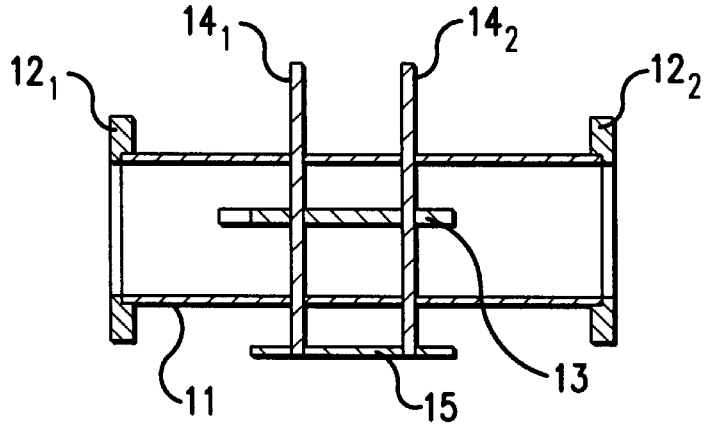
FIG.1C PRIOR ART
Figure 1D:
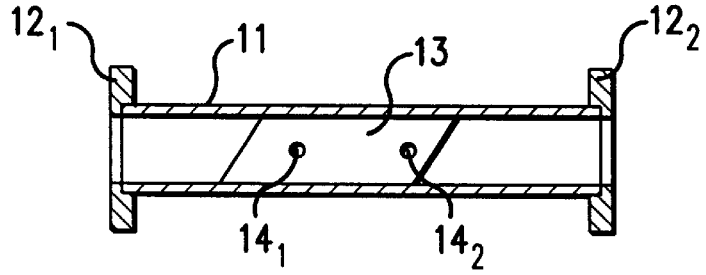
FIG.1D PRIOR ART
Figure 2:
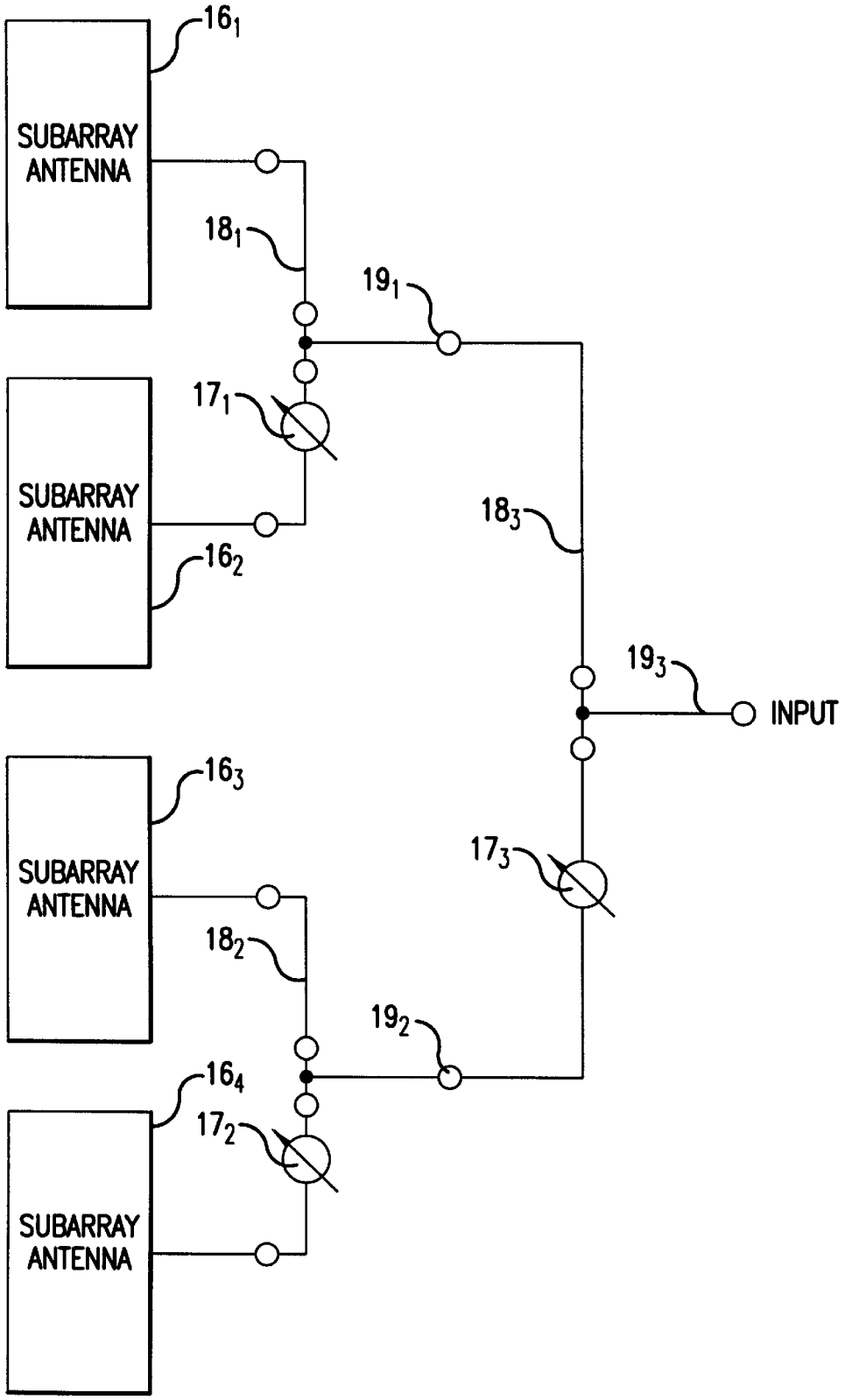
FIG.2 PRIOR ART
FIG. 2 shows an example of the use of the prior-art phase shifting device shown in FIG. 1.

A comparison of FIG. 27 and FIG. 2 clearly shows that, while the structure of a power supply circuit using a phase shifting device of the prior art was complicated by the requirement for a transmission path having a standard amount of phase shift and a two-branch circuit for each phase shifter, the use of a phase shifting device of the present invention results in a power supply circuit of extremely simple construction because the phase shifting device of the present invention has an effect equivalent to the combination of a prior-art phase shifting device, a transmission path having a standard amount of phase shift, and a two-branch circuit.

The foregoing description relates to an example (see FIG. 21) in which sealed cases $\mathbf{31}_1$ and $\mathbf{31}_2$ of coupler 31 are formed from metal; the first driver installed in coupler 31 is formed from a microstrip antenna composed of sealed case $\mathbf{31}_1$ which serves as a ground conductor, round insulation plate $\mathbf{31}_{51}$, and driver element $\mathbf{31}_{61}$; and the second driver is formed from a microstrip antenna composed of sealed case $\mathbf{31}_2$ which serves as a ground conductor, round insulation plate $\mathbf{31}_{52}$, and driver element $\mathbf{31}_{62}$. However, if sealed cases $\mathbf{31}_1$ and $\mathbf{31}_2$ are each formed by applying a metal film to the outer surface of a base body composed of a suitable synthetic resin, the metal film applied to the outer surface of the base body of sealed case $\mathbf{31}_1$ can be used as a ground conductor, the base body itself of sealed case $\mathbf{31}_1$ can be used as round insulation plate $\mathbf{31}_{51}$, and as a result, the first driver composed of a microstrip antenna can be formed by attaching driver element $\mathbf{31}_{61}$ to the inner surface of the bottom wall of sealed case $\mathbf{31}_1$, and the second driver composed of a microstrip antenna can be formed by attaching driver element $\mathbf{31}_{62}$ to the inner surface of the bottom wall of sealed case $\mathbf{31}_2$.

For a case in which sealed cases $\mathbf{31}_1$ and $\mathbf{31}_2$ are formed by multilayer stacking of dielectric plates, the first driver composed of a microstrip antenna can be formed by attaching driver element $\mathbf{31}_{61}$ to the inner surface and attaching a ground conductor to the outer surface of the bottom wall of sealed case $\mathbf{31}_1$, and the second driver composed of a microstrip antenna can be formed by attaching driver element $\mathbf{31}_{62}$ to the inner surface and attaching a ground conductor to the outer surface of the bottom wall of sealed case $\mathbf{31}_2$.

Figure 28:
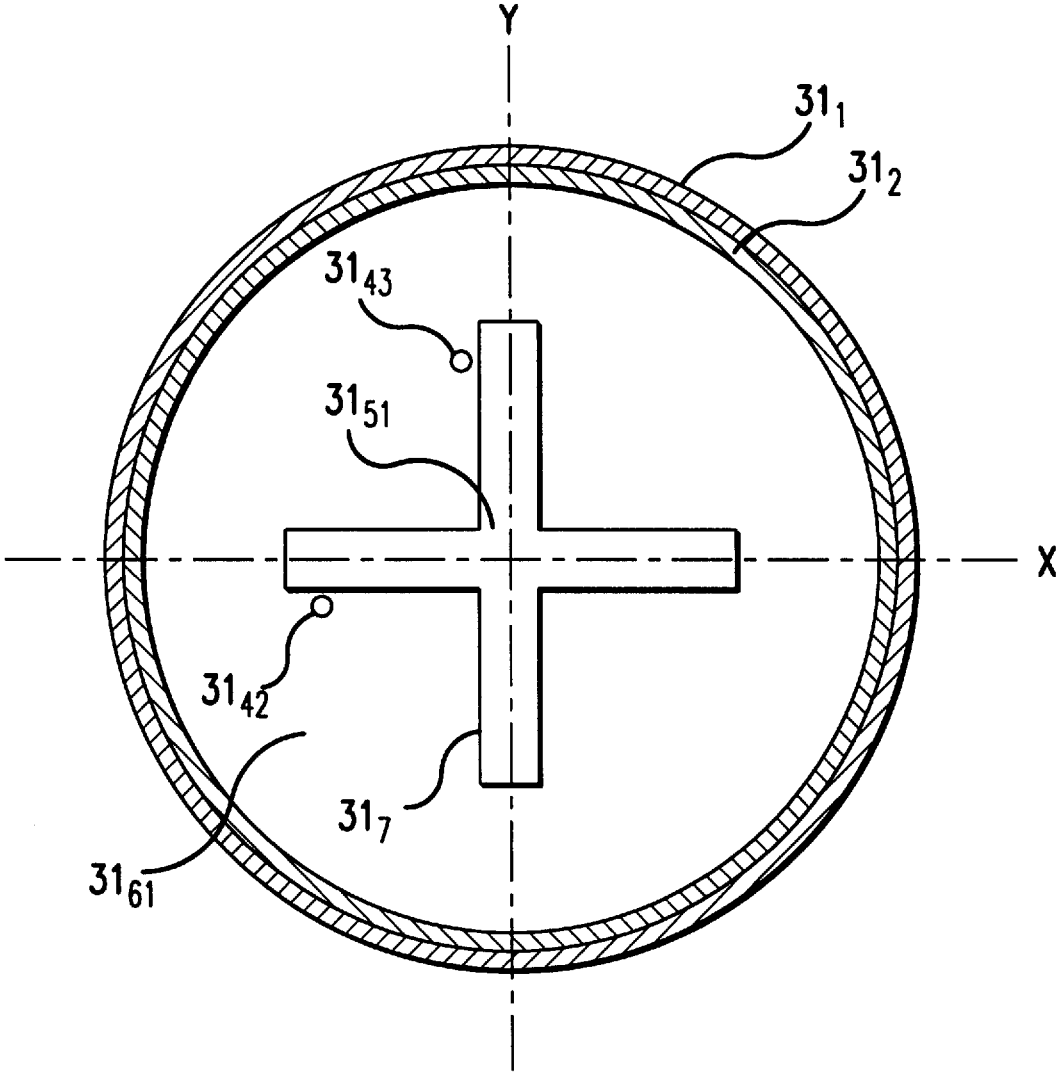
FIG. 28 is a sectional view showing the principal parts of the phase shifting device according to another embodiment of the present invention.

As shown in FIG. 28 in a sectional view similar to that of FIG. 20, instead of being formed from a microstrip antenna, the second driver may be formed from a slot antenna achieved by providing a cross-shaped slot $\mathbf{31}_7$ in the center of metal plate or metal film $\mathbf{31}_{62}$ forming the driver element; and the first driver may be formed as a slot antenna composed of only a slot in the vertical direction or in the horizontal direction of the cross-shaped slot of FIG. 28. Other reference numerals and construction in FIG. 28 is as for FIG. 20.

In this embodiment as well, if sealed cases $\mathbf{31}_1$ and $\mathbf{31}_2$ are formed by applying a metal film to the outer surface of a base body composed of a suitable synthetic resin, the metal film applied to the outer surface of the base body may be used as the ground conductor, and the base body itself can be used as round insulation plates $\mathbf{31}_{51}$ and $\mathbf{31}_{52}$; and if sealed cases $\mathbf{31}_1$ and $\mathbf{31}_2$ are formed by multilayer stacking of dielectric plates, first and second drivers composed of slot antennas can be formed by attaching driver elements $\mathbf{31}_{61}$ and $\mathbf{31}_{62}$ composed of a metal plate or metal film provided with a single-line slot or a cross-shaped slot to the inner surfaces of the bottom walls of each of sealed cases $\mathbf{31}_1$ and $\mathbf{31}_2$ and attaching ground conductors to the outer surfaces of each bottom wall.

In addition, the first driver may be formed by connecting a probe to internal conductor $\mathbf{31}_{41}$ of coaxial conection plug $\mathbf{31}_{31}$ shown in FIG. 19; and the second driver may be formed by connecting probes to internal conductors $\mathbf{31}_{42}$ and $\mathbf{31}_{43}$ of coaxial connection plug $\mathbf{31}_{32}$ and $\mathbf{31}_{33}$ shown in FIG. 20, the longitudinal direction of both probes being parallel to metal plate or metal film $\mathbf{31}_{62}$ and the portions extending in the longitudinal direction of both probes intersecting at the center point of metal plate or metal film $\mathbf{31}_{62}$, this intersection being a right angle.

In either of the above-described constructions of the first and second drivers installed in sealed cases $\mathbf{31}_1$ and $\mathbf{31}_2$, respectively, the amount of phase shift between input and output is determined according to the relative angle of rotation between sealed cases $\mathbf{31}_1$ and $\mathbf{31}_2$, and to rotate sealed cases $\mathbf{31}_1$ and $\mathbf{31}_2$ relative to each other, a construction may be adopted wherein sealed case $\mathbf{31}_2$, coaxial cables $\mathbf{33}_1$ and $\mathbf{33}_2$, and 90° 3-dB hybrid circuit 32 are fixed and sealed case $\mathbf{31}_1$ is caused to rotate; wherein sealed case $\mathbf{31}_1$ is fixed and sealed case $\mathbf{31}_2$, coaxial cables $\mathbf{33}_1$ and $\mathbf{33}_2$, and 90° 3-dB hybrid circuit 32 are caused to rotate as a unit; or wherein sealed case $\mathbf{31}_1$ and 90° 3-dB hybrid circuit 32 are fixed, coaxial cables $\mathbf{33}_1$ and $\mathbf{33}_2$ is formed from a flexible cable, and sealed case $\mathbf{31}_2$ is caused to rotate.

The foregoing explanation relates to a case in which sealed cases $\mathbf{31}_1$ and $\mathbf{31}_2$ are both formed as cylinders with one closed end, but either sealed case $\mathbf{31}_1$ or $\mathbf{31}_2$ may be formed as a cylinder with one closed end in which the first or second driver is installed, and the other sealed case, i.e., sealed case $\mathbf{31}_2$ or $\mathbf{31}_1$ may be formed as a disk-shaped cover with the second or first driver attached to its inner surface and formed such that the cover rotatably fits with the end portion of the opening of the cylinder with one closed end.

The foregoing explanation relates to a case in which 90° 3-dB hybrid circuit 32 is formed as a quarter-wave coupled-line directional coupler, but the hybrid circuit may also be formed as a branch line directional coupler.

In addition, for cases in which the transmission frequency bandwidth is relatively narrow, a two-branch terminal circuit may take the place of 90° 3-dB hybrid circuit 32, and the length of one of coaxial cables $\mathbf{33}_1$ and $\mathbf{33}_2$, for example coaxial cable 332, may be formed exactly one transmission quarter-wavelength longer than coaxial cable $\mathbf{33}_1$.

In this embodiment, the lengths of coaxial cable $\mathbf{33}_1$ and $\mathbf{33}_2$ must differ by exactly one transmission quarter-wavelength, but fabrication is relatively easy because the difference in length between coaxial cables $\mathbf{33}_1$ and $\mathbf{33}_2$ is fixed at one transmission quarter-wavelength.

If the difference in lengths between coaxial cables $\mathbf{33}_1$ and $\mathbf{33}_2$ is selected to be one transmission quarter-wavelength for the center frequency of the transmission band, the difference in length between the coaxial cables will not precisely match the quarter-wavelength for frequencies outside the center frequency, but since this embodiment is intended for applications in which the transmission frequency band is relatively narrow, any operational error arising due to variance from the quarter-wavelength is minute and presents no practical problem.

The foregoing explanation relates to a case in which the phase shifting device is constructed by assembling three-dimensional constituent elements, but the entire structure can be miniaturized by forming 90° 3-dB hybrid circuit 32 on a printed circuit board using a printed wiring method and forming coaxial cables $\mathbf{33}_1$ and $\mathbf{33}_2$ as microstrip wiring.

The entire structure may also be made extremely compact and concise by providing a dielectric layer on the outer surface of sealed case $\mathbf{31}_2$ of coupler 31, and then employing a printed wiring method to form 90° 3-dB hybrid circuit 32 and microstrip wiring that takes the place of coaxial cables $\mathbf{33}_1$ and $\mathbf{33}_2$.

In a case in which a two-branch terminal circuit takes the place of 90° 3-dB hybrid circuit 32, the entire structure can be miniaturized by forming this component on a printed circuit board or on a dielectric layer provided on the outer surface of sealed cases $\mathbf{31}_2$.

What is claimed is:

1. A phase shifting device comprising:

two-partition circuit means for partitioning input power into two substantially equal portions having a mutual phase difference of substantially 90°;

first driver means for generating a circularly polarized wave that is driven by two-partitioned output of said two-partition circuit means;

second driver means for receiving said circularly polarized wave generated by said first driver means;

a sealed case comprising first and second cylinders each having one cylindrical side wall and one closed end on which one of said first and second driver means is installed;

an end portion of said side wall of said first cylinder fitting with an end portion of said side wall of said second cylinder;

said first and second cylinders being rotatable relative to each other around their cylindrical axis;

inner diameters of said first and second cylinders giving cutoff modes at the frequency of the wave driven by said first driver means; and combining circuit means for combining linearly polarized orthogonal components generated from said circularly polarized wave received by said second driver means.

2. A phase shifting device comprising:

two-partition circuit means for partitioning input power into two substantially equal portions having a mutual phase difference of substantially 90°;

first driver means for generating a circularly polarized wave that is driven by two-partitioned output of said two-partition circuit means;

second driver means for receiving said circularly polarized wave generated by said first driver means;

a sealed case comprising a cylinder with one cylindrical side wall and one closed end on which either one of said first and second driver means is installed, and a disk-shaped cover having one circular end which fits with an end portion of said side wall of said cylinder and upon the inner surface of which is attached the other of said first and second driver means, said cylinder and said cover being rotatable relative to each other around a cylindrical axis of said cylinder, an inner diameter of said cylinder giving cutoff modes at the frequency of the wave driven by said first driver means; and combining circuit means for combining linearly polarized orthogonal components generated from said circularly polarized wave received by said second driver means.

3. A phase shifting device comprising:

an input terminal;

first driver means for generating a linearly polarized wave that is driven by an input applied to said input terminal;

second driver means for receiving said orthogonal components of said linearly polarized wave generated by said first driver means;

a sealed case comprising first and second cylinders each having one cylindrical side wall and one closed end on which one of said first and second driver means is installed;

an end portion of said side wall of said first cylinder fitting with an end portion of said side wall of said second cylinder;

said first and second cylinders being rotatable relative to each other around their cylindrical axis;

inner diameters of said first and second cylinders giving cutoff modes at the frequency of the wave driven by said first driver means; and combining circuit means for combining two outputs generated from two orthogonal components of said linearly polarized wave received by said second driver means.

4. A phase shifting device comprising:

an input terminal;

first driver means for generating a linearly polarized wave that is driven by an input applied to said input terminal;

second driver means for receiving said orthogonal components of said linearly polarized wave generated by said first driver means;

a sealed case comprising a cylinder with one cylindrical side wall and one closed end on which either one of said first and second driver means is installed, and a disk-shaped cover having one circular end which fits with an end portion of said side wall of said cylinder and upon the inner surface of which is attached the other of said first and second driver means, said cylinder and said cover being rotatable relative to each other around a cylindrical axis of said cylinder, an inner diameter of said cylinder giving cutoff modes at the frequency of the wave driven by said first driver means; and combining circuit means for combining two outputs generated from two orthogonal components linearly polarized wave received by said second driver means.

5. A phase shifting device according to any one of claims 1–4, wherein said first and second driver means each comprise microstrip antennas.

6. A phase shifting device according to any one of claims 1–4, wherein said first and second driver means each comprise slot antennas.

7. A phase shifting device according to any one of claims 1–4, wherein said combining circuit means comprises a 90° 3-dB hybrid circuit.

8. A phase shifting device according to any one of claims 1–4, wherein said combining circuit means comprises a two-branch terminal circuit.

* * * * *